United States Patent [19]

Ishikawa et al.

[11] Patent Number: 4,801,516

[45] Date of Patent: Jan. 31, 1989

[54] METHOD OF PROCESSING SILVER HALIDE COLOR PHOTOGRAPHIC MATERIAL USING A DEVELOPER COMPRISING A HYDROXYLAMINE AND AN ANTIFOGGANT

[75] Inventors: Takatoshi Ishikawa; Morio Yagihara, both of Minami-ashigara, Japan

[73] Assignee: Fuji Photo Film Co., Ltd., Kanagawa, Japan

[21] Appl. No.: 66,022

[22] Filed: Jun. 24, 1987

[30] Foreign Application Priority Data

Jun. 25, 1986 [JP] Japan ..... 61-147037

[51] Int. Cl.[4] ..... G03C 7/30

[52] U.S. Cl. ..... 430/380; 430/372; 430/434; 430/435; 430/436; 430/464; 430/467; 430/478; 430/484; 430/485; 430/489; 430/490

[58] Field of Search ..... 430/380, 250, 372, 432, 430/434, 435, 436, 464, 484, 483, 485, 490, 489, 478, 467

[56] References Cited

U.S. PATENT DOCUMENTS

| | | | |
|---|---|---|---|
| 3,287,124 | 11/1966 | Green et al. | 430/484 |
| 3,287,125 | 11/1966 | Green et al. | 430/484 |
| 3,293,034 | 12/1966 | Green et al. | 430/484 |
| 3,362,961 | 1/1968 | Green et al. | 430/484 |
| 3,491,151 | 1/1970 | Bader | 430/250 |
| 3,996,054 | 12/1976 | Santemma et al. | 430/372 |
| 4,252,892 | 2/1981 | Case | 430/489 |
| 4,414,305 | 11/1983 | Nakamura et al. | 430/489 |
| 4,418,140 | 11/1983 | Mifune et al. | 430/489 |
| 4,451,555 | 5/1984 | Pollet et al. | 430/489 |
| 4,524,132 | 6/1985 | Aoki et al. | 430/553 |
| 4,542,091 | 9/1985 | Sasaki et al. | 430/380 |
| 4,543,322 | 9/1985 | Ishikawa et al. | 430/380 |

FOREIGN PATENT DOCUMENTS

| | | |
|---|---|---|
| 59-160141 | 9/1984 | Japan . |
| 59-160142 | 9/1984 | Japan . |
| 59-184341 | 10/1984 | Japan . |
| 61-43742 | 3/1986 | Japan . |

OTHER PUBLICATIONS

Research Disclosure 18359, "Processing Method . . . ", Jul. 1979, p. 392.

*Primary Examiner*—Paul R. Michl
*Assistant Examiner*—Patrick A. Doody
*Attorney, Agent, or Firm*—Birch, Stewart, Kolasch & Birch

[57] ABSTRACT

There is provided a method of processing a silver halide color photographic material which comprises processing the silver halide color photographic material with a color developer containing an aromatic primary amine color developing agent and a specific hydroxylamine compound. According to this method the stability of a color developer is improved so that the increased fogging problem in continuous processing is lessened and the processing time is shortened.

31 Claims, No Drawings

METHOD OF PROCESSING SILVER HALIDE COLOR PHOTOGRAPHIC MATERIAL USING A DEVELOPER COMPRISING A HYDROXYLAMINE AND AN ANTIFOGGANT

BACKGROUND OF THE INVENTION (1) Field of the Invention

The invention relates to a method of processing a silver halide color photographic material, and more particularly to a method of processing a silver halide color photographic material in which the stability of a color developer is improved so that the increased fogging problem in continuous processing is lessened and the processing time is shortened.

(2) Description of the Prior Art

Reflecting the demand for a shorter customer waiting period and reduced laboratory work, it has been desirable to shorten the processing time of color photographic materials in recent years. As ways of shortening the time of each processing step, it was a routine practice to raise the temperature or increase the replenishing amount. Numerous other approaches have also been proposed, including the use of intensified agitation and the addition of various accelerators or promotors.

Of these, Japanese Patent Application (OPI) Nos. 95345/1983, 23242/1984, 19140/1985 and 70552/1986 disclose a method of processing a color photographic material which contains an emulsion of silver chloride with a view towards speeding up color development and/or reducing the replenishing amount. When a photographic material utilizing an emulsion of such a high chlorine content is processed, hydroxylamine, which has conventionally been used as a preservative for color developers, cannot be used because it induces silver development (black and white development) and significantly lowers the dye density as described in Japanese Patent Application (OPI) No. 19140/1985. For this reason, a dihydroxybenzenecarboxylic acid was used in lieu of hydroxylamine in the invention of the patent application. This approach, however, was still unable to sufficiently stabilize a color developer.

Various preservatives and chelating agents have been investigated for many years with a view towards improving the stability of color developers. As exemplary preservatives may be mentioned the aromatic polyhydroxy compounds described in Japanese Patent Application (OPI) Nos. 49828/1977, 160142/1984 and 47038/1981 and U.S. Pat. No. 3,746,544; the hydroxycarbonyl compounds described in U.S. Pat. No. 3,615,503 and British Pat. No. 1,306,176; the α-aminocarbonyl compounds described in Japanese Patent Application (OPI) Nos. 143020/1977 and 89425/1978; the alkanolamines described in Japanese Patent Application (OPI) No. 3532/1979; and the metal salts described in Japanese Patent Application (OPI) Nos. 44148/1982 and 53749/1982. On the other hand, illustrative examples of such chelating agents include the aminopolycarboxylic acids described in Japanese Patent Publication Nos. 30496/1973 and 30232/1969; the organophosphonic acids described in Japanese Patent Application (OPI) No. 97347/1981, Japanese Patent Publication No. 39359/1981 and West German Pat. No. 2,227,639; phosphonocarboxylic acids described, for example, in Japanese Patent Application (OPI) Nos. 102726/1977, 42730/1978, 121127/1979, 126241/1980 and 65956/1980; and further, compounds described, for example, in Japanese Patent Application (OPI) Nos. 195845/1983 and 203440/1983 and Japanese Patent Publication No. 40900/1978.

Use of the above-described various preservatives and chelating agents was, however, unable to bring about sufficient effects for color developers which did not contain hydroxylamine.

Furthermore, color photographic materials which contain a chlorobromide emulsion having a high chlorine content tend to develop fogging upon color development as disclosed in Japanese Patent Application (OPI) Nos. 95345/1983 and 232342/1984. The techniques disclosed in these patent publications, however, failed to prevent fogging satisfactorily. Other methods used to prevent development fogging have been to add, in photographic materials or processing solutions, heterocyclic compounds such as 1-phenyl-5-mercptotetrazoles (see, for example, Belgium Pat. No. 671,406, U.S. Pat. Nos. 3,295,976, 3,376,310, 3,615,616, 3,071,465, 3,420,664 and 2,403,927, and Japanese Patent Application (OPI) Nos. 37436/1975 and 95728/1983), benzotriazoles (see, for example, British Pat. Nos. 919,061 and 768,438, U.S. Pat. Nos. 3,157,509 and 3,082,088, and German Pat. No. 617,712), benzimidazoles (see, for example, U.S. Pat. Nos. 3,137,578, 3,148,066 and 3,511,663, British Pat. Nos. 271,475, 1,344,548, 3,148,066 and 3,511,663, and German Pat. Nos. 708,424, 635,769 and 2,205,539), and imidazoles (see, for example, U.S. Pat. Nos. 3,106,467, 3,420,670, 1,763,990 and 2,271,229). None of these heterocyclic compounds, however, were able to achieve sufficient antifogging effects.

BRIEF SUMMARY OF THE INVENTION

An object of this invention is therefore to provide a processing method of a silver halide color photographic material in which the stability of a color developer can be improved to significantly lessen the increased fogging problem of continuous processing.

Another object of this invention is to provide a processing method of a silver halide color photographic material which can shorten the development time and also prevent color density reduction.

A further object of this invention is to provide a processing method of a silver halide color photographic material which does not use benzyl alcohol and does not lower the color-forming property of the color photographic material.

Other and further objects, features and advantages of the invention will be detailed more fully in the following description.

DETAILED DESCRIPTION OF THE INVENTION

As a result of extensive research, the inventors have discovered that the above-described objectives have been successfully realized by the following:

A method of processing a silver halide color photographic material, which comprises iamgewise exposing a silver halide color photographic material to light and then processing the silver halide color photographic material containing (i) an aromatic primary amine color developing agent, and (ii) a hydroxylamine compound represented by the following general formula (I):

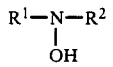

General formula (I)

wherein $R^1$ and $R^2$ each represent an unsubstituted or substituted alkyl, alkenyl or aryl group (hereinafter and in claims simply referred to as alkyl, alkenyl or aryl group) and may optionally joined together to form a heterocyclic ring with the associated nitrogen atom and at least one compound selected from the group consisting of formulae (II-a), (II-b) and (II-c) which are described hereinbelow.

In the present invention it is preferable that the color developer be substantially free of benzyl alcohol from the viewpoint of prevention of environmental contamination, convenience of preparation of the developer solution and prevention of fogging. The term "substantially free" as used in this specification and claims means that the content of benzyl alcohol is not higher than 2 ml per liter of the color developer. It is more preferable in the present invention that benzyl alcohol not be contained at all. Fogging can be reduced further by making the color developer substantially free of benzyl alcohol, as mentioned above.

In the present invention, the color developer contains at least one compound selected from compounds represented respectively by the following general formulae (II-a), (II-b) or (II-c): General formula (II-a)

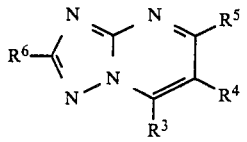

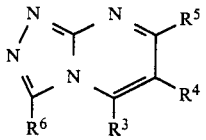

General formula (IIb)

wherein $R^3$, $R^4$, $R^5$ and $R^6$, which may be the same or different, each represent a hydrogen atom; a substituted or unsubstituted alkyl, aryl or amino group (hereinafter and in claims simply referred to as alkyl, aryl or amino group); a hydroxyl group; an alkoxy group; an alkylthio group; a carbamoyl group which may optionally be substituted; a halogen atom; a cyano group; a carboxyl group; an alkoxycarbonyl group, or a heterocyclic group; and $R^3$ and $R^4$ or $R^4$ and $R^5$ may form a 5 or 6-membered ring in combination, with a proviso that at least one of $R^3$ and $R^5$ represents a hydroxyl group.

Z—S—M wherein M represents a hydrogen atom, cation or —S—Z (Z represents a heterocyclic ring containing at least one nitrogen atom).

It is already disclosed in Japanese Patent Application (OPI) No. 232342/1984 to use the compounds of the general formula (IIc) used in the present invention to prevent fogging. It was, however, used in the presence of benzyl alcohol, and as such the antifogging effects were low. In the present invention, a remarkable antifogging effect is exhibited in a system which is substantially free of benzyl alcohol. This is by no means expected from the description of Japanese Patent Application (OPI) No. 232342/1984. Exclusion of benzyl alcohol generally resulted in a reduction of the color-forming property. It is quite unpredictable that the color-forming property is substantially unaffected by the omission of benzyl alcohol in the presence of the compound of the general formula (I).

The compound of the general formula (I) will next be described in detail.

In the general formula (I), the alkyl and alkenyl groups represented by each of $R^1$ and $R^2$ may be linear, branched or cyclic. As exemplary substituents which these alkyl, alkenyl and aryl groups may contain may be mentioned halogen atoms (e.g., F, Cl, Br), aryl groups (e.g., phenyl, p-chlorophenyl), alkoxy groups (e.g., methoxy, ethoxy, methoxyethoxy), aryloxy groups (e.g., phenoxy), sulfonyl groups (e.g., methanesulfonyl, p-toluenesulfonyl), sulfonamido groups (e.g., methanesulfonamido, benzenesulfonamido), sulfamoyl groups (e.g., diethylsulfamoyl, unsubstituted sulfamoyl), carbamoyl groups (e.g., unsubstituted carbamoyl, diethylcarbamoyl), amido groups (e.g., acetamido, benzamido), ureido groups (e.g., methylureido, phenylureido), alkoxycarbonylamino groups (e.g., methoxycarbonylamino), aryloxycarbonylamino groups (e.g., phenoxycarbonylamino), alkoxycarbonyl groups (e.g., methoxycarbonyl), aryloxycarbonyl groups (e.g., phenoxycarbonyl), cyano group, hydroxyl group, carboxyl group, sulfo group, nitro group, amino groups (e.g., unsubstituted amino, diethylamino), alkylthio groups (e.g., methylthio), arylthio groups (e.g., phenylthio), and heterocyclic groups (e.g., morpholinyl, pyridyl). Here, $R^1$ and $R^2$ may be the same or different. In addition, the substituents in $R^1$ and $R^2$ may also be the same or different.

$R^1$ and $R^2$ may preferably have carbon atoms of 1–10 with 1–5 being especially preferred. As illustrative examples of the nitrogen-containing heterocyclic ring which is formed when $R^1$ and $R^2$ are joined together may be mentioned piperidyl groups, pyrrolidinyl groups, N-alkylpiperazyl groups, morpholinyl groups, indolinyl groups and benztriazolyl groups.

Preferable substituents on $R^1$ and $R^2$ are hydroxyl groups, alkoxy groups, sulfonyl groups, amido groups, carboxyl groups, cyano groups, sulfo groups, nitro groups and amino groups.

It is preferable in the present invention that at least one of $R^1$ and $R^2$ be a group having one or more further substituents.

Hydroxylamines (I), in which $R^1$ and $R^2$ are both unsubstituted alkyl groups, are not preferable due to their poor preserving ability and offensive odor.

Specific examples of the compound represented by the general formula (I) useful in the practice of this invention will be described below. It should be borne in mind, however, that the scope of this invention is not limited to the following compounds.

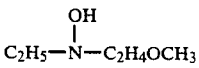

I-(1)

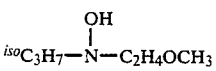

I-(2)

-continued

I-(3)

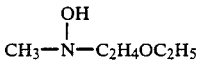

I-(4)

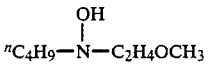

I-(5)

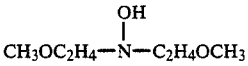

I-(6)

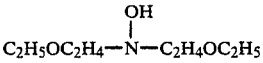

I-(7)

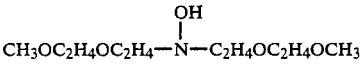

I-(8)

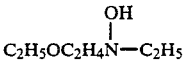

I-(9)

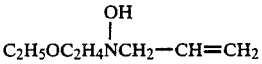

I-(10)

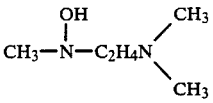

I-(11)

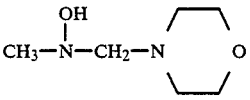

I-(12)

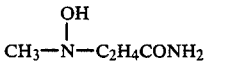

I-(13)

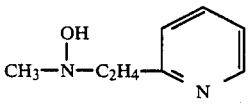

I-(14)

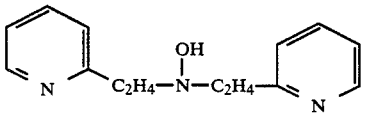

I-(15)

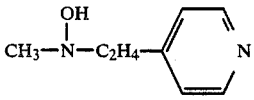

I-(16)

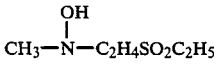

I-(17)

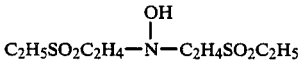

I-(18)

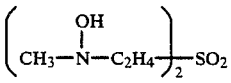

I-(19)

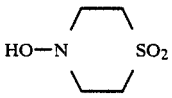

-continued

I-(20)

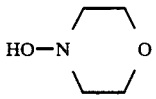

I-(21)

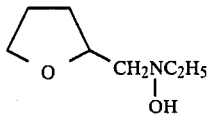

I-(22)

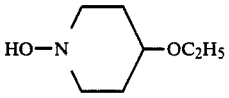

I-(23)

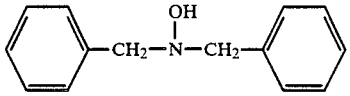

I-(24)

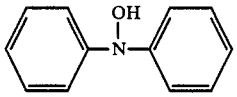

I-(25)

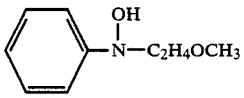

I-(26)

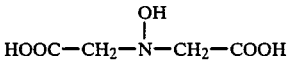

I-(27)

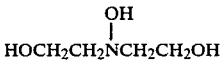

I-(28)

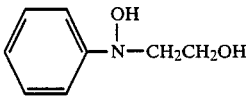

I-(29)

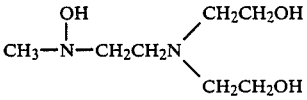

I-(30)

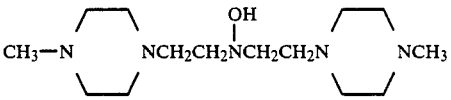

Compounds represented by the general formula (I) can be synthesized by known processes described in the following publications.

U.S. Pat. No. 3,661,996;
U.S. Pat. No. 3,362,961;
U.S. Pat. No. 3,293,034;
Japanese Patent Publication No. 2794/1967;
U.S. Pat. No. 3,491,151;
U.S. Pat. No. 3,655,764;
U.S. Pat. No. 3,467,711;
U.S. Pat. No. 3,455,916;
U.S. Pat. No. 3,287,125; and
U.S. Pat. No. 3,287,124.

These compounds may be used in the form of salts with various acids such as hydrochloric acid, sulfuric acid, nitric acid, phosphoric acid, oxalic acid and acetic acid.

To a color developer, these compounds may each be added in an amount of 0.1–20 g, preferably 0.5–10 g, per liter of the color developer.

A description will next be made of the compounds of the general formulae (IIa) and (IIb) which are also useful in this invention.

In these formulae, $R^3$, $R^4$, $R^5$ and $R^6$ may be the same or different and represent individually a hydrogen atom, a substituted or unsubstituted alkyl group which has 1–20 carbon atoms in a cyclic or branched form, an unsubstituted or substituted monocyclic or bicyclic aryl group, an unsubstituted or substituted amino group, a hydroxyl group, an alkoxy group having 1–20 carbon atoms, an alkylthio group having 1–6 carbon atoms, a carbamoyl group which may have one or more aliphatic or aromatic groups as a substituent, a halogen atom, a cyano group, a carboxyl group, an alkoxycarbonyl group having 2–20 carbon atoms, or a heterocyclic group containing a 5 or 6-membered ring having one or more hetero atoms such as nitrogen, oxygen and/or sulfur atoms. $R^3$ and $R^4$ or $R^5$ and $R^6$ may, in combination, form a 5 or 6-membered ring. At least one of $R^3$ and $R^5$, however, is a hydroxyl group.

Illustrative examples of the unsubstituted alkyl group may include methyl, ethyl, n-propyl, i-propyl, n-butyl, t-butyl, hexyl, cyclohexyl, cyclopentylmethyl, octyl, dodecyl, tridecyl and heptadecyl. As exemplary substituents in the substituted alkyl group may be mentioned monocyclic and bicyclic arylgroups, heterocyclic groups, halogen atoms, carboxyl groups, alkoxycarbonyl groups having 2–6 carbon atoms, alkoxy groups having not more than 20 carbon atoms and hydroxyl groups. Specific examples of the substituted alkyl group may include benzyl, phenethyl, chloromethyl, 2-chloroethyl, trifluoromethyl, carboxymethyl, 2-carboxyethyl, 2-(methoxycarbonyl)ethyl, ethoxycarbonylmethyl, 2-methoxyethyl, hydroxymethyl and 2-hydroxyethyl. Illustrative examples of the unsubstituted aryl group may include phenyl and naphthyl. When an aryl group is further substituted, exemplary substituents may be alkyl groups having 1–4 carbon atoms, halogen atoms, nitro groups, carboxyl groups, alkoxycarbonyl groups having 2–6 carbon atoms, hydroxyl groups and alkoxy groups having 1–6 carbon atoms. Illustrative examples of the substituted aryl group may include p-tolyl, m-tolyl, p-chlorophenyl, p-bromophenyl, o-chlorophenyl, m-nitrophenyl, p-carboxyphenyl, o-carboxyphenyl, o-(methoxycarbonyl)phenyl, o-hydroxyphenyl, p-methoxyphenyl and m-ethoxyphenyl.

The amino group represented by each of $R^3$, $R^4$, $R^5$ and $R^6$ may have a substituent. As exemplary substituents may be mentioned alkyl groups (e.g., methyl, ethyl, butyl) and acyl groups (e.g., acetyl, methylsulfonyl). As illustrative substituted amino groups may be mentioned a dimethylamino group, diethylamino group, butylamino group and acetylamino group.

As specific examples of the alkoxy group represented by each of $R^3$, $R^4$, $R^5$ and $R^6$ may be mentioned a methoxy group, ethoxy group, butoxy group and heptadecyloxy group.

The carbamoyl group represented by each of $R^3$, $R^4$, $R^5$ and $R^6$ may contain as substituent or substituents one or more alkyl groups having 1–20 carbon atoms, or monocyclic or bicyclic aryl groups. As specific examples of the substituted carbamoyl group may be mentioned a methylcarbamoyl group, dimethylcarbamoyl group, ethylcarbamoyl group and phenylcarbamoyl group.

Specific examples of the alkoxycarbonyl group represented by each of $R^3$, $R^4$, $R^5$ and $R^6$ may include a methoxycarbonyl group, ethoxycarbonyl group and butoxycarbonyl group.

As specific examples of the halogen atom represented by each of $R^3$, $R^4$, $R^5$ and $R^6$ may be mentioned a chlorine atom and bromine atom.

The heterocyclic group represented by each of $R^3$, $R^4$, $R^5$ and $R^6$ may be monocyclic or may contain a fused bicyclic or tricyclic ring. Specific examples may include a furyl group, pyridyl group, 2-(3-methyl)benzothiazolyl group and 1-benzotriazolyl group.

Illustrative examples of the ring formed by $R^3$ and $R^4$ or by $R^4$ and $R^5$ may include cyclopentane, cyclohexane, cyclohexene, benzene, furan, pyrrolidine and thiophene.

When $R^6$ represents a substituted alkyl group, a heterocyclic group may be contained as a substituent. Substituted alkyl groups represented by the following general formula are preferred:

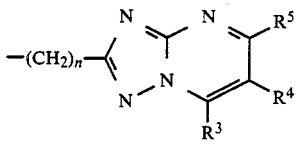

wherein $R^3$, $R^4$ and $R^5$ have the same meaning as defined above and n stands for 2 or 4.

Specific examples of the compound represented by the general formula (IIa) or (IIc) will be described below, though it should be borne in mind that the present invention is not limited to them.

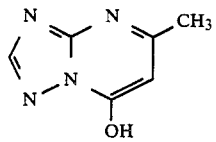

IIa-1

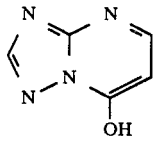

IIa-2

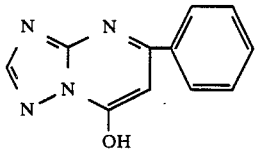

IIa-3

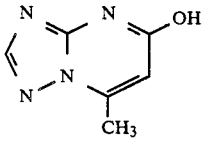

IIa-4

-continued
IIa-5
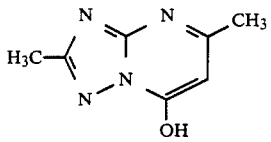
IIa-6
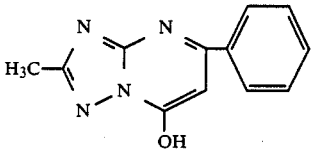
IIa-7
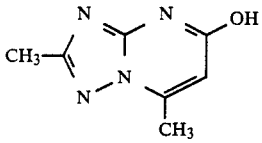
IIa-8
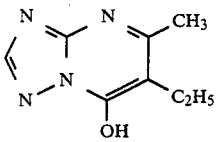
IIa-9
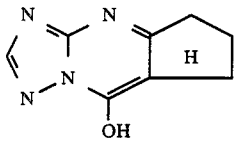
IIa-10
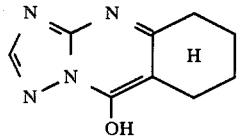
IIa-11
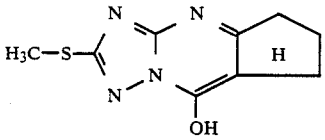
IIa-12
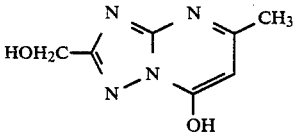
IIa-13
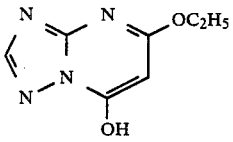
IIa-14
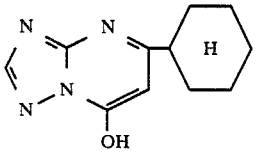
-continued
IIa-15
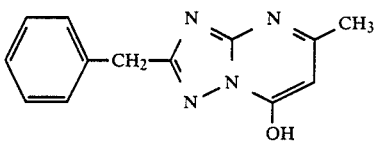
IIa-16
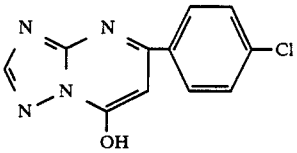
IIa-17
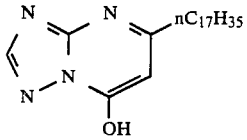
IIa-18
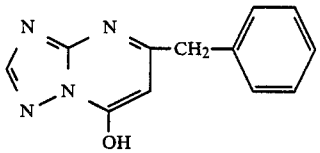
IIa-19
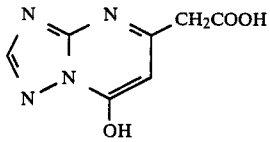
IIa-20
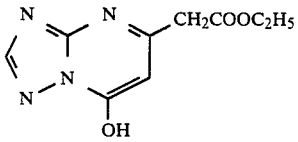
IIa-21
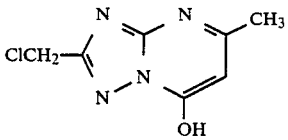
IIa-22
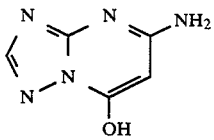
IIa-23
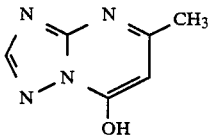
IIa-24
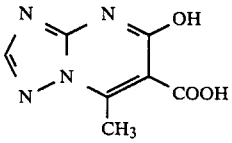

-continued

IIa-25

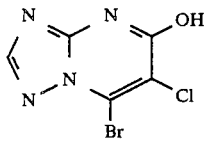

IIa-26

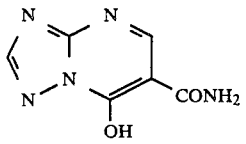

IIa-27

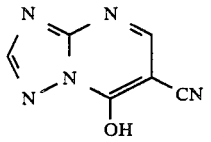

IIa-28

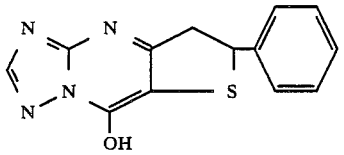

IIa-29

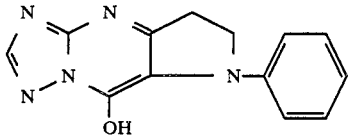

IIa-30

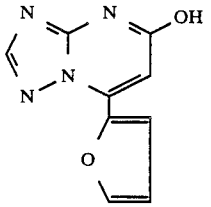

IIa-31

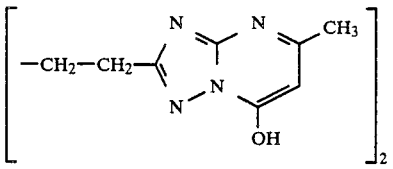

IIa-32

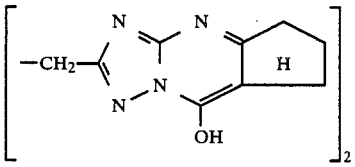

IIb-1

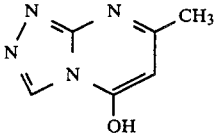

-continued

IIb-2

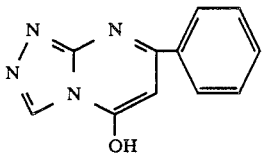

IIb-3

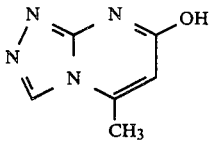

IIb-4

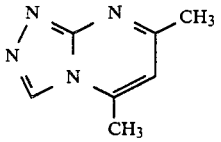

IIb-5

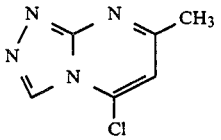

IIb-6

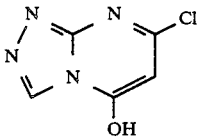

IIb-7

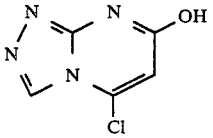

The compounds of the general formula (IIa) can be easily synthesized with reference to Bülow and Haas, Berichte, 42, 4638 (1907) and ibid. 43, 375 (1910); Allen, et al., J. Org. Chem., 24, 796 (1959); De Cat and Dormael, Bull. Soc. Chim. Belg., 60, 69 (1951); and Cook, et al., Rec. Trav. Chem., 69, 343 (1950).

On the other hand, the compounds of the general formula (IIb) can be easily synthesized with reference to Bower and Doyle, J. Chem. Soc., 1957, 727; and Allen, et al., J. Org. Chem., 24, 787 (1959).

The compounds represented by the general formula (IIc) will next be described in detail.

The heterocyclic group represented by Z in the above general formula (IIc) may be a fused one. Specific examples may include imidazole, triazole, tetrazole, thiazole, oxazole, selenazole, benzimidazole, benzoxazole, benzthiazole, thiadiazole, oxadiazole, benzselenazole, pyrazole, pyrimidine, triazine, pyridine, naphthothiazole, naphthoimidazole, naphthoxazole, azabenzimidazole, purine and azaindenes (e.g., triazaindene, tetrazaindene, pentazaindene).

These heterocyclic groups and fused rings may be substituted by suitable substituents. As exemplary substituents may be mentioned alkyl groups (e.g., methyl, ethyl, hydroxyethyl, trifluoromethyl, sulfopropyl, dipropylaminoethyl, adamantane), alkenyl groups (e.g., allyl), aralkyl groups (e.g., benzyl, p-chlorophenethyl), aryl groups (e.g., phenyl, naphthyl, p-carboxyphenyl, 3,5-di-carboxyphenyl, m-sulfophenyl, p-acetamidophenyl, 3-capramidophenyl, p-sulfamoylphenyl, m-hydroxyphenyl, p-nitrophenyl, 3,5-dichlorophenyl, 2-methoxyphenyl), heterocyclic groups (e.g., pyridine groups, furan groups, thiophene groups), halogen atoms (e.g., chlorine atom, bromine atom), mercapto, cyano, carboxyl, sulfo, hydroxyl, carbamoyl, sulfamoyl, amino and nitro groups, alkoxy groups (e.g., methoxy), aryloxy groups (e.g., phenoxy), acyl groups (e.g., acetyl), acylamino groups (e.g., acetylamino, capramido, methylsulfonylamido), substituted amino groups (e.g., diethylamino, hydroxyamino), alkyl- or aryl-thio groups (e.g., methylthio, carboxyethylthio, sulfobutylthio), alkoxycarbonyl groups (e.g., methoxycarbonyl), and aryloxycarbonyl groups (e.g., phenoxycarbonyl).

The compounds represented by the general formula (I) can be synthesized with reference to, for example, E. J. Birr, "Stabilization of Photographic Silver Halide Emulsions" (Focal Press Inc., 1974); C. G. Barlow, et al., "Rep. Prog. Appln. Chem." 59, 159 (1974); and various literature cited in "Research Disclosure", 17643 (1978).

Specific examples of the compound represented by the general formula (IIc) useful in this invention will next be described. It should be borne in mind, however, that the present invention is not limited to them.

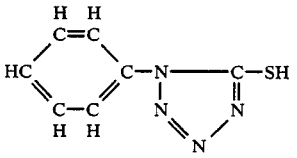

(IIc-1)

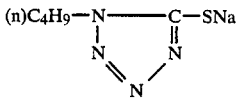

(IIc-2)

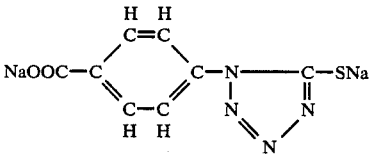

(IIc-3)

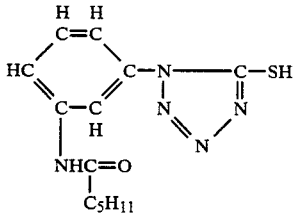

(IIc-4)

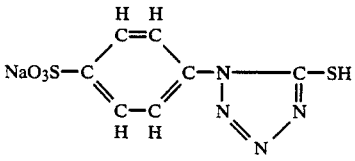

(IIc-5)

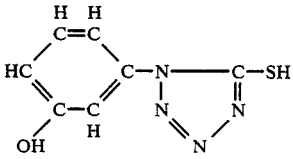

(IIc-6)

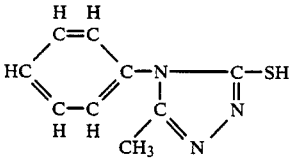

(IIc-7)

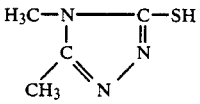

(IIc-8)

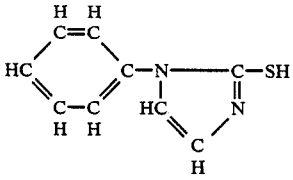

(IIc-9)

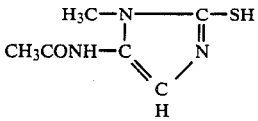

(IIc-10)

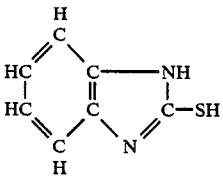

(IIc-11)

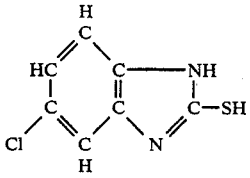

(IIc-12)

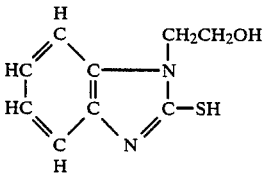

(IIc-13)

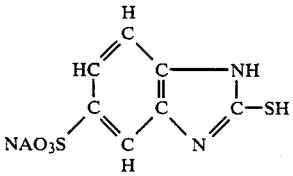

(IIc-14)

-continued
(IIc-15)
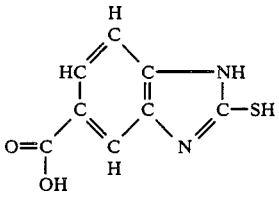
(IIc-16)
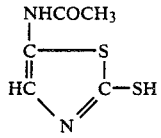
(IIc-17)
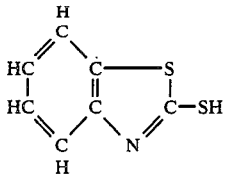
(IIc-18)
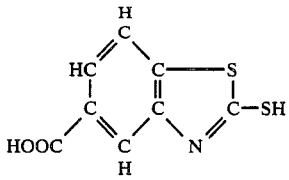
(IIc-19)
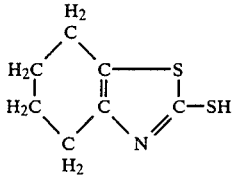
(IIc-20)
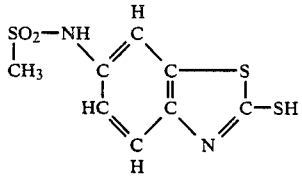
(IIc-21)
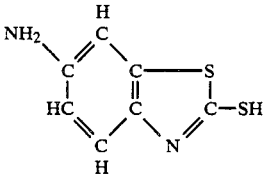
(IIc-22)
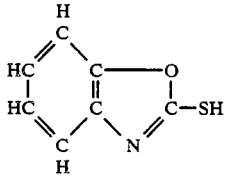
(IIc-23)
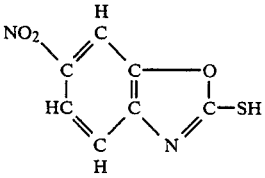
(IIc-24)
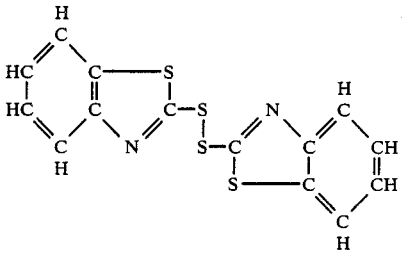
(IIc-25)
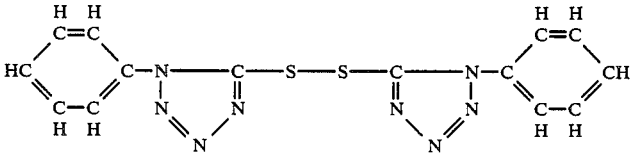
(IIc-26)
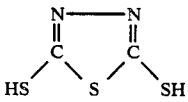
(IIc-27)
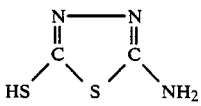
(IIc-28)
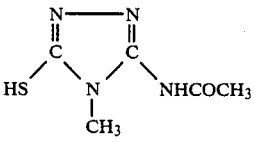
(IIc-29)
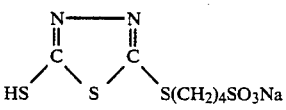
(IIc-30)
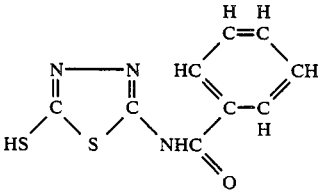
(IIc-31)
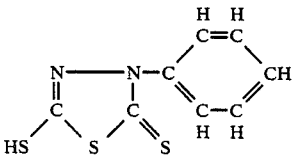

-continued

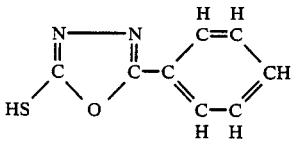

(IIc-32)

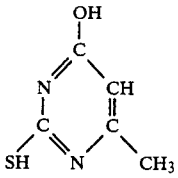

(IIc-33)

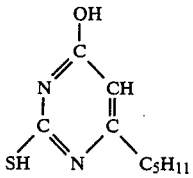

(IIc-34)

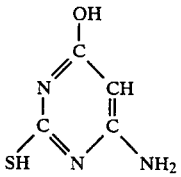

(IIc-35)

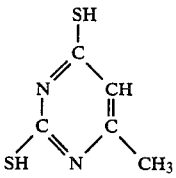

(IIc-36)

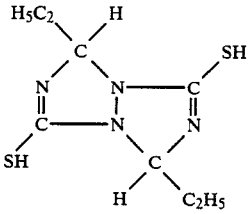

(IIc-37)

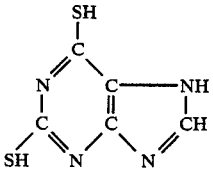

(IIc-38)

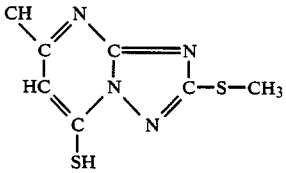

(IIc-39)

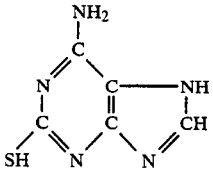

(IIc-40)

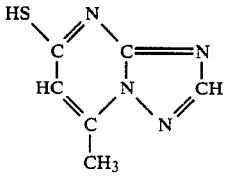

(IIc-41)

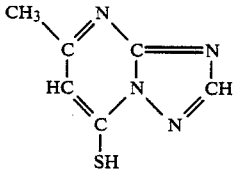

(IIc-42)

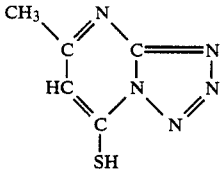

(IIc-43)

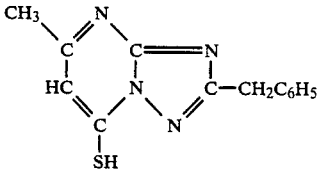

(IIc-44)

The compounds of general formulae (IIa), (IIb) and (IIc) may each be added, in an amount of 5 mg–3 g, preferably 10 mg–1 g, per liter of the color developer.

Thee antifogging agents may each be dissolved out from a color photographic material into a color developer in the course of its processing, such that the amount of antifogging agent mentioned above may accumulate in the color developer.

The color developer of this invention contains an aromatic primary amine as a color developing agent. Preferable examples of the aromatic primary amine are p-phenylenediamine derivatives. Typical examples will be given below. It should be borne in mind, however, that the aromatic primary amine is not necessarily limited to the following typical examples.

D-1 N,N-diethyl-p-phenylenediamine
D-2 2-amino-5-diethylaminotoluene
D-3 2-amino-5-(N-ethyl-N-laurylamino)toluene
D-4 4-[N-ethyl-N-(β-hydroxyethyl)amino]aniline
D-5 2-methyl-4-[N-ethyl-N-(β-hydroxyethyl-)amino]aniline
D-6 N-ethyl-N-(β-methanesulfonamidoethyl)-3-methyl-4-aminoaniline
D-7 N-(2-amino-5-diethylaminophenylethyl)methanesulfonamide D-8 N,N-dimethyl-p-phenylenediamine
D-9 4-amino-3-methyl-N-ethyl-N-methoxyethylaniline
D-10 4-amino-3-methyl-N-ethyL-N-β-ethoxyethylaniline
D-11 4-amino-3-methyl-N-ethyl-N-β-butoxyethylaniline These p-phenylenediamine derivatives may also be used in the form of salts such as sulfates, hydrochlorides, sulfites and p-toluenesulfonates. The developing agents of the aromatic primary amine type may each be used in an amount of about 0.1 g–about 20 g, more preferably about 0.5–about 10 g, per liter of developer.

It is preferable that the color developer employed in the present invention not contain hydroxylamine. When hydroxylamine is contained, it is preferable to lower its content as much as possible.

It is also preferable to contain, as a preservative, a sulfite such as sodium sulfite, potassium sulfite, sodium bisulfite, potassium bisulfite, sodium metasulfite or potassium metasulfite, or a carbonyl sulfite addition product. The preservative may be added in an amount of 0 g–20 g/l, preferably 0 g–5 g/l. A smaller amount is preferable, provided that the stability of the color developer is retained.

As other preservatives may be mentioned the hydroxyacetones described in U.S. Pat. No. 3,615,503 and British Pat. No. 1,306,176; the α-aminocarbonyl compounds described in Japanese patent application (OPI) Nos. 14302/1977 and 89425/1978; the various metals described, for example, in Japanese patent application (OPI) Nos. 44148/1982 and 53749/1982; the various saccharides described in Japanese patent application (OPI) No. 102727/1977; the hydroxamic acids described in Japanese patent application (OPI) No. 27638/1977; the α,α'-dicarbonyl compounds described in Japanese patent application (OPI) No. 160141/1984; the salicyclic acids described in Japanese patent application (OPI) No. 180588/1984; the alkanolamines described in Japanese patent application (OPI) No. 3532/1979; the poly(alkyleneimines) described in Japanese patent application (OPI) Nos. 94349/1981; and the gluconic acid derivatives described in Japanese patent application (OPI) No. 75647/1981. Two or more of these preservatives may be used in combination as needed.

It is particularly preferable to add an alkanolamine (e.g., triethanol amine, diethanolamine) and/or an aromatic polyhydroxyl compound.

The color developer useful in this invention preferably has a pH in the range of 9–12, with a pH of 9–11.0 being more preferable. The color developer may contain other compounds, known as developer components.

It is preferable to use a buffering agent to maintain the above pH.

As exemplary usable buffering agents may be mentioned carbonates, phosphates, borates, tetraborates, hydroxybenzoates, glycine salt, N,N-dimethylglycine salts, leucine salts, norleucine salts, guanine salts, 3,4-dihydroxyphenylalanine salts, alanine salts, aminobutyrates, 2-amino-2-methyl-1,3-propanediol salts, valine salts, proline salts, trishydroxyaminomethane salts, lysine salts. Carbonates, phosphates, tetraborates and hydroxybenzoates have special merits; they have excellent solubility and buffering effects in the pH range of 9.0 and higher; they contribute no deleterious effects (e.g., fogging) to photographic performance through their incorporation in color developers; and they are economical. It is hence particularly preferable to use these buffering agents.

As specific examples of these buffering agents may be mentioned sodium carbonate, potassium carbonate, sodium bicarbonate, potassium bicarbonate, trisodium phosphate, tripotassium phosphate, bisodium phosphate, bipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate) and potassium 5-sulfo-2-hydroxybenzoate (potassium 5-sulfosalicylate). However, the present invention is not limited to these compounds.

To the color developer, the buffering agents may each be added in an amount of 0.1 mole per liter of the color developer, with 0.1 mole/l–0.4 mole/l being especially preferred.

In addition, various chelating agents may also be used in the color developer as a suspension agent for calcium and magnesium, or for improving the stability of the color developer.

Organic acid compounds are preferably used as chelating agents, including for example the aminopolycarboxylic acids described in Japanese Patent Publication Nos. 30496/1973 and 30232/1969; the organophosphonic acids described in Japanese patent application (OPI) No. 97347/1981, Japanese Patent Publication No. 39359/1981 and West German Pat. No. 2,227,639; phosphonocarboxylic acids described, for example, in Japanese patent application (OPI) Nos. 102726/1977, 42730/1978, 121127/1979, 126241/1980 and 65956/1980; and compounds described, for example, in Japanese patent application (OPI) Nos. 195845/1983 and 203440/1983 and Japanese Patent Publication No. 40900/1978. Specific examples will be given below. It should, however, be borne in mind that the present invention is not limited to the following organic acid compounds.

Ethylenediaminetetraacetic acid;
Diethylenetriaminepentaacetic acid;
Triethylenetetraminehexaacetic acid;
N,N,N-Trimethylenephosphonic acid;
Ethylenediamine-N,N,N',N'-tetramethylenephosphonic acid;
1,3-Diamino-2-propanoltetraacetic acid;
Transcyclohexanediaminetetraacetic acid;
Nitrilotripropionic acid;
1,2-Diaminopropanetetraacetic acid;
Hydroxyethyliminodiacetic acid;
Glycoletherdiaminetetraacetic acid;
Hydroxyethylenediaminetriacetic acid;
Ethylenediamineorthohydroxyphenylacetic acid;
2-Phosphonobutane-1,2,4-tricarboxylic acid;
1-Hydroxyethylidene-1,1-diphosphonic acid; and
N,N'-bis(2-hydroxybenzyl)ethylenediamine-N,N'-diacetic acid.

Two or more of these chelating agents may be used in combination if necessary.

These chelating agents may each be added in an amount sufficient to sequester metal ions in the color developer: for example in an amount of about 0.1 g--about 10 g per liter of color developer.

It is also possible to incorporate a desired development accelerator in the color developer as needed. As exemplary development accelerators may be mentioned thioether compounds described, for example, in Japanese Patent Publication Nos. 16088/1962, 5987/1962, 7826/1963, 12380/1969 and 9019/1970 and U.S. Pat. No. 3,813,247; the p-phenylenediamine compounds described in Japanese patent application (OPI) Nos. 49829/1977 and 15554/1975; quaternary ammonium salts described, for example, in Japanese patent application (OPI) No. 137726/1975, Japanese Patent Publication No. 30074/1969 and Japanese patent application (OPI) Nos. 156826/1981 and 43429/1977; the p-aminophenols described in U.S. Pat. Nos. 2,610,122 and 4,119,462; amine compounds described, for example, in U.S. Pat. Nos. 2,494,903, 3,128,182, 4,230,796 and 3,253,919, Japanese Patent Publication No. 11431/1966 and U.S. Pat. Nos. 2,482,546, 2,596,926 and 3,582,346; polyalkylene oxides described, for example, in Japanese Patent Publication Nos. 16088/1962 and 25201/1967, U.S. Pat. No. 3,128,183, Japanese Patent Publication Nos. 11431/1966 and 23883/1967 and U.S. Pat. No. 3,532,501; 1-phenyl-3-pyrazolidones; hydrazines; mesoionic compounds; ionic compounds; and imidazoles.

It is preferable to use as an antifogging agent at least one of the compounds represented respectively by the general formulae (IIa), (IIb) and (IIc) in the present invention. One or more other desired antifogging agents may also be added. As such antifogging agents may be used alkali metal halides such as sodium chloride, potassium bromide and potassium iodide, as well as organic antifogging agents. As typical organic antifogging agents may be mentioned nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole and hydroxyazaindolizine.

It is preferable to incorporate a brightening agent in the color developer useful for this invention. A 4,4'-diamino-2,2'-disulfostilbene compound is preferred as such a brightening agent. It may be added in an amount of 0–5 g/l, preferably 0.1 g–2 g/l.

Various surfactants such as alkylsulfonic acids, arylphosphonic acids, aliphatic carboxylic acids and aromatic carboxylic acids may also be added as needed.

The processing temperature for the color developer in this invention may be 20°–50° C,., preferably 30°–40° C. The processing time may be 20 seconds–5 minutes, preferably 30 seconds–2 minutes. Although a smaller replenishing amount is more preferred, it may be 20–600 ml, preferably 50–300 ml per $m^2$ of a photographic material. Most preferably of all is the range of from 100 ml to 200 ml.

A description will next be made of bleaching solutions, bleach-fix solutions, and fixers which are useful in the invention.

Illustrative examples of the bleaching agent usable in a bleaching solution, and bleach-fix solutions which are useful in the invention may include organic acid complex salts of iron (III), for example, the complex salts of aminopolycarboxylic acids such as ethylenediaminetetraacetic acid and diethylenetriamine-pentaacetic acid, the complex salts of aminopolyphosphonic acids, the complex salts of phosphonocarboxylic acids, and the complex salts of organophosphonic acid, or organic acids such as citric acid, tartaric acid and malic acid; persulfates; or hydrogen peroxide. Of these, the organic acid complex salts of iron (III) are preferred from the view-point of fast processing and the prevention of environmental contamination. As exemplary aminopolycarboxylic acids, aminopolylphosphonic acids, organic phosphonic acids and their salts, which are useful to form organic complex salts of iron (III), may be mentioned ethylenediaminetetraacetic acid, diethylenetriaminepentaacetic acid, ethylenediamine-N-(β-oxyethyl)-N,N',N'-triacetic acid, 1,3-diaminopropanetetraacetic acid, triethylenetetraminehexaacetic acid, propylenediaminetetraacetic acid, nitrolotriacetic acid, nitrilotripropionic acid, cyclohexanediaminetetraacetic acid, 1,3-diamino-2-propanoltetraacetic acid, methyliminodiacetic acid, iminodiacetic acid, hydroxyliminodiacetic acid, dihydroxyethylglycineethyletherdiaminetetraacetic acid, glycoletherdiaminetetraacetic acid, ethylenediamine-tetrapropionic acid, ethylenediaminedipropionic acid, phenylenediaminetetraacetic acid, 2-phosphonobutane-1,2,4-triacetic acid, 1,3-diaminopropanol-N,N,N',N'-tetramethylenephosphonic acid, ethylenediamine-N,N,N'-N'-tetramethylenephosphonic acid, 1,3-propylenediamine-N,N,N',N'-tetramethylenephosphonic acid and 1-hydroxyethylidene-1,1-diphosphonic acid.

These compounds may be in the form of sodium, potassium, lithium or ammonium salts. Among these compounds, the iron(III) complex salts of ethylenediaminetetraacetic acid, diethylenetriaminepentaacetic acid, cyclohexanediaminetetraacetic acid, 1,3-diaminopropane-tetraacetic acid and methyliminodiacetic acid are preferred for their strong bleaching power.

The iron (III) complex salts may be utilized as the complex salt itself, or as a solution in which the iron (III) complex salt is formed from a ferric salt (e.g., ferric sulfate, ferric chloride, ferric nitrate, ammonium ferric sulfate, ferric phosphate, etc.) and a chelating agent (e.g., aminopolycarboxylic acid, aminopolyphosphonic acid, phosphonocarboxylic acid, etc.). Two or more kinds of the complex salts can be used in combination. When forming complex salts in the solution, one or more kinds of ferric salts or chelating agents may be used. In any case, the chelating agent may be used in an excess amount over that required to form complex salt with ferric salt. Among the iron (III) complex salts, iron (III) complex salts with aminocarboxylic acid are preferable, and they may be added in an amount of 0.01–1.0 mol/l, though preferably in an amount of 0.05–0.50 mol/l.

In a bleaching solution or a bleach-fix solution, various accelerators can be used as needed. Examples of useful bleach accelerators include compounds having mercapto groups or disulfido groups described, for example, in U.S. Pat. No. 3,893,858, West German Pat. Nos. 1,290,812 and 2,059,988, Japanese patent application (OPI) Nos. 32736/1978, 57831/1978, 37418/1978, 65732/1978, 72623/1978, 95630/1978, 95631/1978, 104232/1978, 124424/1978, 141623/1978 and 28426/1978, and *Research Disclosure* No. 17129 (June, 1978); thiazolizine derivertives described, for example, in Japanese patent application (OPI) No. 140129/1975; thiourea derivertives described in Japanese Patent Publication No. 8506/1970, Japanese patent application (OPI) Nos. 20832/1977 and 32735/1978, U.S. Pat. No. 3,706,561; iodide compounds described in West German Pat. No. 1,127,715 and Japanese patent application (OPI) No. 16235/1983; polyethyleneoxide described in West German Pat. Nos. 966,410 and 2,748,430; polyamine compounds described in Japanese Patent Publication 8836/1967; compounds described in Japanese patent application (OPI) Nos. 42434/1974, 59644/1974, 94927/1978, 35727/1979, 26506/1980 and 163040/1983; and iodine and bromine ions. In view of their accelerating effect, compounds having mercapto groups or disulfido groups are preferable, and the compounds described in U.S. Pat. No.3,893,858, West German Pat. No. 1,290,812 and Japanese patent application (OPI) No. 95630/1978 are especially preferable.

A bleaching solution or a bleach-fix solution in this invention may be incorporated with rehaloenation agents such as bromide (e.g., potassium bromide, sodium bromide and ammonium bromide), chloride (e.g., potassium chloride, sodium chloride and ammonium chloride) and iodide (e.g., ammonium iodide). There may be added one or more kinds of inorganic or organic acids and their alkaline metal, or ammonium salts which have a pH buffering action such as boric acid, borax, sodium metaborate, acetic acid, sodium acetate, sodium carbonate, potassium carbonate, phosphorous acid, phosphoric acid, sodium phosphate, citric acid, sodium citrate and tartaric acid; and a corrosion inhibitor such as ammonium nitrate and guanidine.

Examples of the fixing agent used in a bleach-fix solution or a fixing solution in this invention include known fixing agents: that is, water soluble silver halide solubilizing agent such as thiosulfates (e.g., sodium thiosulfate, ammonium thiosulfate, etc.), thiocyanates (e.g., sodium thiocyanate, ammonium thiocyanate, etc.), thioether compounds (e.g., ethylenebisthioglycolic acid, 3,6-dithia-1,8-octanediol, etc.) and thioureas. The fixing agent may be alone or in combination. The specific bleach-fix solution comprising a combination of a fixing agent and a large amount of halide such as potassium iodide as described in Japanese patent application (OPI) No. 155354/1980 may be used. In this invention, the use of a thiosulfate, especially a ammonium thiosulfate, is preferable.

An amount of the fixing agent used per liter of fixing solution or bleach-fix solution is preferably in the range of 0.3–2 mol, with 0.5–1.0 being most preferable.

The bleaching solution or the bleach-fix solution used in this invention preferably has a pH in the range of 3–10, with the range of 4–9 being more preferable. At a pH lower than this range, the desilvering property may be improved, but deterioration of the solution and leucolization of cyan dyes may be accelerated. On the other hand, at a higher pH than this range desilvering may be retarded, but stain may occur.

In order to adjust the pH of the solution, there may be added as needed such compounds as hydrochloric acid, sulfulic acid, nitric acid, acetic acid, bicarbonate, ammonia, caustic potash, caustic soda, sodium carbonate and potassium carbonate.

The bleach-fix solution may contain a brightening agent, a defoamer, a surfactant or a organic solvent such as polyvinylpyrrolidone or methanol.

As a preservative, the bleach-fix solution or the bleaching solution may contain sulfite ion releasing compounds such as sulfites (e.g., sodium sulfite, potassium sulfite, ammonium sulfite, etc.), bisulfites (e.g., ammonium bisulfite, sodium bisulfite, potassium bisulfite, etc.), or metabisulfites (e.g., potassium metabisulfite, sodium metabisulfite, ammonium metabisulfite, etc.). A preferable amount of these compounds, in terms of sulfite ion, is in the range of 0.02–0.50 mol/l, more preferably in the range of 0.04–0.40 mol/l.

Sulfites are usually used as the preservative, but ascorbic acid, carbonyl-bisulfite adduct, or carbonyl compounds may be added.

Further, there may be added as needed such a constituent as a buffering agent, brightening agent, chelating agent or antifungal agent.

Turning to the washing step in this invention, water-washing treatment may be replaced by a simple washing treatment such as so-called "stabilization processing", in which no water-washing step is substantially contained. Thus, the water-washing step of this invention should be broadly interpreted.

Although it is difficult to define an amount of water in the washing step in this invention (because it differs depending, for example, on the number of baths in the counter flow washing process or the carry-over amount of the forward bath constituent by the photographic material), it is preferred in this invention that the concentration of the constituents of the bleaching or fix solution in the last washing bath be $1\times10^{-4}$ mol/l or less. For example, in the case of three-tank counter flow washing, the preferable amount of washing water to be used is 1000 ml or more, more preferably 5000 ml or more, per square meter of photographic material. In the case of a water saving processing, an amount of water in the range of 100–1000 ml per square meter of photographic material is preferable.

The temperature of the washing step is in the range of 15°–45° C., more preferably in the range of 20°–35° C.

Water for the washing step may be incorporated with a variety of known compounds to prevent precipitation or to stabilize the washing water. For example, a chelating agent such as inorganic phosphoric acid, aminopolycarboxylic acid, and organic phosphonic acid; various germicide or antifungal agents, e.g., a compound as described in *J. Antibact. Antifug. Agents* Vol. 11, No. 5, pp. 207–223 (1983),and a compound described in "The Chemistry of Germicide and Antifungal Agents" by Hiroshi Horiguchi; a metallic salt represented by magnesium salt or aluminum salt; an alkaline metal salt or ammonium salt; or a surfactant for reducing drying load and to prevent precipitation may be added if necessary. A compound such as described in West, *Photo. Sci. Eng.* Vol. 6, pp. 344–359 (1965), may also be added.

Furthermore, this invention is particularly effective with a multi step (over two steps) counter flow washing process in which a chelating agent and a germicide or antifungal agent is added to save on the amount of washing water. This invention is also particularly effective in employing a multi step counter flow stabilization treatment process (i.e., stabilization processing), described in Japanese patent application (OPI) No. 8543/1982, instead of an ordinary water washing process. In these cases, the contents of the bleaching or fixing constituents in the last bath are preferably $5\times10^{-2}$ mol/l or less, more preferably $1\times10^{-2}$ mol/l or less.

Various compounds are added to the stabilization bath of this invention for image stabilization. Examples of these additives include a variety of buffering agents (e.g., an optional combination of borate, metaborate, borax, phosphate, carbonate, potassium hydroxide, sodium hydroxide, aqueous ammonia, monocarboxylic acid, dicarboxylic acid, and polycarboxylic acid) and an aldehyde such as formalin for adjusting pH of the membrane (e.g., pH 3–8). In addition, chelating agents (e.g., inorganic phosphoric acid, aminopolycarboxylic acid, organic phosphonic acid, aminopolyphosphonic acid, or phosphonocarboxylic acid), germicides (e.g., thiazoles, isothiazoles, halogenated phenols, sulfanilamides, or benzotriazoles), a surfactant, brightening agent, hardening agent and other additives may be respectively used alone or in combination for the same or differing purposes.

The addition of ammonium salts, such as ammonium chloride, ammonium nitrate, ammonium sulfate, ammonium phosphate, ammonium sulfate and ammonium thiosulfate, for adjusting the pH of the processor membrane is preferable in view of the improvement of photographic image preservability.

When the amount of washing water is to be conserved, as described above, it is preferable to feed back a part or all of the overflowed washing water into a forward bath such as a bleach-fix or fixing bath to reduce the amount of waste water.

In the continuous processing of this invention, a constant finished photography is attainable by preventing variations of each processing liquid's composition by adding each replenisher. The amount of replenisher to be added can be reduced to half or less the standard amount of replenisher for cost-savings.

Each processing bath may be provided with a heater, temperature sensor, level sensor, circulating pump, filter, floating lid, squeezer, and agitation by nitrogen gas or air, as required.

The method of this invention can be applied to any processing process using color developer. For example, it can be applied to a method of processing a color paper, a color reversal paper, color positive film, color negative film, or color reversal film.

The silver halide emulsion of the silver halide color photographic material to be used in this invention may be any type of halogen composition including silver iodobromide, silver bromide, silver chlorobromide, or silver chloride. A silver chlorobromide emulsion containing 60 mol% or more of silver chloride or a silver chloride emulsion is preferable to prevent fogging and to speed up the processing. A silver halide emulsion containing 80–100 mol% of silver chloride is most preferable of all.

The silver halide crystals may have such a structure that the internal phase differs from the surface phase, the entire crystals may have a uniform phase, they may be polyphase with a joining structure, or a mixture thereof.

The average size of the silver halide grains, expressed in terms of the grain diameter for spherical or semi-spherical grains and in terms of the edge length for cubic grains can be determined as the average of the projected area diameter etc., and it is preferably smaller than 2 microns and larger than 0.1 microns, most preferably smaller than 1 micron and larger than 0.15 microns.

The distribution of grain size may be either narrow or wide. A monodisperse emulsion of silver halide may be employed in the present invention. The monodisperse emulsion may have a fluctuation coefficient as a monodisperse index of 20% or less, preferably 15% or less, which coefficient is obtained by dividing the standard deviation calculated from the curve of the size distribution by the average particle size. In order to realize the gradation desired for the photographic material, two or more monodisperse silver halide emulsions different in grain size may be mixed in a single layer, or coated as different layers having essentially the same color sensitivity. Further, two or more polydisperse silver halide emulsions or combination of monodisperse and polydisperse emulsions can be employed as a mixture in one layer, or coated as different layers.

Silver halide grains for use in this invention may have a regular crystal structure such as cubic, hexahedral, dodecahedral or tetradecahedral structure, an irregular crystal structure such as a spherical structure, or a composite crystal structure thereof. Tabular grains may be employed wherein at least 50 percent of the total projected area of silver halide grains is tabular grains having a diameter-to-thickness ratio of about 5 or more, particularly to about 8 or more. Silver halide emulsions may be a mixture of various crystal structures. Silver halide grains may be used which form a latent image primary on the grain surface, or which form a latent image primary in the interior of the grains.

The photographic emulsion for use in this invention can be prepared by the processes described in P. Glafkides, *Chimie et Physique Photographique,* Paul Montel (1967), G. F. Duffin, *Photographic Emulsion Chemistry,* The Focal Press (1966), V. L. Zelikman et al., *Making and Coating Photographic Emulsions,* The Focal Press (1964), etc. Any one of an acidic process, a neutral process, and an ammoniacal process can be used. As a means of reacting a soluble silver salt with a soluble halide salt, any of the single jet method, double jet method or a combination thereof may be employed.

A process of forming grains in the presence of excess silver ion (the so-called reversal mixing process) can be employed as well. As one type of the double jet method, the "controlled double jet" process can be employed wherein the pAg in the liquid phase of silver halide formation is kept constant. This process provides a silver halide emulsion containing regular silver halide grains having an approximately monodisperse particle size.

In addition there can be used a silver halide emulsion prepared by the so-called conversion method, comprising a process to convert a silver halide formed during the silver halide formation process to a more insoluble silver halide, and a silver halide emulsion subjected to the conversion treatment after silver halide formation is finished.

During formation or physical ripening of the silver halide grains, cadmium salts, zinc salts, lead salts, thallium salts, iridium salts or the complex salts thereof, rhodium salts or the complex salts thereof, iron salts or the complex salts thereof, etc., may also be present.

After grain formation followed by the usual physical ripening, desalting and chemical ripening, silver halide emulsions are used for coating.

Precipitation, physical ripening and chemical ripening can be carried out in the presence of conventional silver halide solvents (e.g., ammonia, potassium thiocyanate, thioethers and thiones described in U.S. Pat. No. 3,271,157, Japanese Patent Application (OPI) Nos. 12360/1976, 82408/1978, 144319/1978, 100717/1979 and 155828/1979). Removing of soluble salts from emulsions after physical ripening can be achieved by noodle washing, flocculation precipitation or ultrafiltration, etc.

Sulfur sensitization using active gelatine or sulfur-containing compounds capable of reacting with silver (e.g., thiosulfates, thioureas, mercapto compounds, rhodanines, etc.); reduction sensitization using a reductive substance (e.g., stannous salts, amines, hydrazine derivatives, formamidinesulfinic acid, silane compounds, etc.); and noble metal sensitization using noble metal compounds (e.g., complex salts of the Group VIII metals such as Pt, Ir, Pd, Rh, Fe, etc., as well as gold complex salts) can be employed alone or in combination.

Of the chemical sensitization methods mentioned the sole use of sulfur sensitization is more preferable.

Each of blue-sensitive emulsion, green-sensitive emulsion and red-sensitive emulsion is subjected to spectral sensitization with dyes such as methine or the like. Useful dyes include cyanine dyes, merocyanine dyes, complex cyanine dyes, complex merocyanine dyes, holopolar cyanine dyes, hemicyanine dyes, styryl dyes, and hemioxonol dyes. Particularly useful dyes are cyanine dyes, merocyanine dyes and complex merocyanine dyes.

These dyes may have any of the following basic heterocyclic nuclei which are commonly used for cyanine dyes: pyrroline nucleus, oxazoline nucleus, thiazoline nucleus, pyrrole nucleus, oxazole nucleus, thiazole nucleus, selenazole nucleus, imidazole nucleus, tetrazole nucleus, and pyridine nucleus. Those nuclei formed by condensation of the above-mentioned nuclei with an aliphatic hydrocarbon ring or aromatic hydrocarbon ring, such as indolenine nucleus, benzindolenine nucleus, indole nucleus, benzoxazole nucleus, naphthoxazole nucleus, benzothiazole nucleus, naphthothiazole nucleus, benzoselenazole nucleus, benzimidazole nucleus, naphthoimidazole nucleus, quinoline nucleus, and imidazo-(4,5-b)-quinoquizaline nucleus. These nuclei may be substituted on the carbon atom.

The merocyanine dye or compound merocyanine dye may have, as a nucleus having the ketomethylene structure, a 5- or 6-membered hetero ring nucleus such as pyrazolin-5-on nucleus, thiohydantoin nucleus, 2-thiooxazolidine-2,4-dione nucleus, thiazolidine-2,4-dione nucleus, rhodanine nucleus, thiobarbituric acid, 2-thioselenazolidine-2,4-dione nucleus, pyrazolo[1,5-a]benzimidazole, and pyrazolo[5,1-b]quinazolone nucleus.

These sensitizing dyes may be used alone or in combination. A combination of sensitizing dyes is often employed particularly for the purpose of supersensitization. Typical examples are described in U.S. Pat. Nos. 2,688,545, 2,977,229, 3,397,060, 3,522,052, 3,527,641, 3,617,293, 2,628,964, 3,666,480, 3,672,898, 3,679,428, 3,703,377, 3,769,301, 3,814,609, 3,837,862 and 4,026,707, British Pat. Nos. 1,344,281 and 1,507,803, Japanese Patent Publication Nos. 4936/1968 and 12375/1978, and Japanese Patent Application (OPI) Nos. 110618/1977 and 109925/1977.

Together with the sensitizing dye, a supersensitizing substance such as a dye which itself is not sensitizing or a substance which substantially does not absorb visible light may be incorporated in the emulsion.

Dye-forming couplers for incorporation in the present photographic materials are preferably nondiffusible by being ballasted or polymerized. Two-equivalent couplers having a coupling-off group at the coupling active position are more preferable than four-equivalent couplers having only hydrogen at the coupling position, in view of reduced silver coverage. Couplers can be employed in the present invention which form a dye of controlled image smearing or a colorless compound, as well as DIR couplers which release a development inhibiting reagent upon coupling reaction, and couplers releasing a development accelerating agent.

Representative examples of yellow couplers useful in this invention include couplers of the "oil-protected" (hydrophobically ballasted) acylacetoamide type, as illustrated in U.S. Pat. Nos. 2,407,210, 2,875,057, and 3,265,506. Typical examples of two-equivalent yellow couplers preferable in this invention include yellow couplers having an oxygen-linked coupling-off group as illustrated in U.S. Pat. Nos. 3,408,194, 3,447,928, 3,933,501, and 4,022,620; yellow couplers having a nitrogen-linked coupling-off group as illustrated in Japanese Patent Publication No. 10739/1983, U.S. Pat. Nos. 4,401,752 and 4,326,024, *Research Disclosure* No. 18053 (April 1979), British Pat. No. 1,425,020 and German Pat. (OLS), Nos. 2,219,917, 2,261,361, and 2,433,812. Couplers of the α-pivaloyl-acetoanilide type are superior in the fastness of formed dyed particularly on exposure to light, while couplers of the α-benzoylacetoanilide type are capable of forming high maximum density.

Magenta couplers useful for this invention include oil-protected couplers of the indazolone or cyanoacetyl type, preferably of the 5-pyrazolone or pyrazoloazole (e.g., pyrazolotriazole) type. 5-Pyrazolones substituted by an arylamino or acylamino group at the 3-position are preferable in view of the hue and maximum densities of formed dyes, and are illustrated in U.S. Pat. Nos. 2,311,082, 2,343,703, 2,600,788, 2,908,573, 3,062,653, 3,152,896 and 3,936,015.

Preferable coupling-off groups in the two-equivalent 5-pyrazolone couplers are nitrogen-linked coupling-off groups described in U.S. Pat. No. 4,310,619, and an arylthio group described in U.S. Pat. No. 4,351,897. The ballast groups described in European Pat. No. 73,636 have effects to enhance developed density in the 5-pyrazolone couplers.

Examples of pyrazoloazole couplers include pyrazolobenzimidazole described in U.S. Pat. No. 3,369,897, more preferably pyrazolo[5,1-c][1,2,4]triazoles described in U.S. Pat. No. 3,725,067, pyrazolotetrazoles described in *Research Disclosure,* No. 24220 (June 1984), and pyrazolopyrazole described in *Research Disclosure,* No. 24230 (June 1984). Imidazo[1,2-b]pyrazoles, described in European Pat. No. 119,741, are preferably, and pyrazolo[1,5-b][1,2,4]triazoles, described in European Pat. No. 119,860, are particularly preferable with respect to the reduced yellow side-absorption and fastness of developed dyes on exposure to light.

The cyan couplers that can be used in this invention include naphthol couplers and phenol couplers of oil-protected type. An example of a naphthol coupler is that disclosed in U.S. Pat. No. 2,474,293, and preferred examples of naphthol couplers are such two-equivalent naphthol couplers as the oxygen atom splitting-off type disclosed in U.S. Pat. Nos. 4,052,212, 4,146,396, 4,228,233, and 4,296,200. Examples of the phenol couplers are those disclosed in U.S. Pat. Nos. 2,369,929, 2,801,171, 2,772,162, and 2,895,826.

Examples of cyan couplers stable to moisture and heat that can be advantageously used in this invention include phenol cyan couplers having a higher alkyl group than methyl group at the meta position of the phenol nucleus, as disclosed in U.S. Pat. No. 3,772,002, 2,5-diacylamino-substituted phenol cyan couplers disclosed in U.S. Pat. Nos. 2,772,162, 3,758,308, 4,126,396, 4,334,011, 4,327,173, German Pat. (OLS) No. 3,329,729 and Japanese Patent Publication No. 42671/1983, and phenol cyan couplers having a phenylureido group at the 2-position and an acylamino group at the 5-position disclosed in U.S. Pat. Nos. 3,446,622, 4,333,999, 4,451,559, and 4,427,767.

It is possible to improve the grainness by using the color couplers in combination with a coupler which forms a dye having a proper degree of diffusion. A magenta coupler of such type is disclosed in U.S. Pat. No. 4,366,237 and British Pat. No. 2,125,570; and a similar type of yellow, magenta, or cyan coupler is disclosed in European Pat. No. 96,570 and West German Patent Application (OLS) No. 3,234,533.

The dye-forming couplers and the special couplers described above may be dimeric, oligomeric or polymeric. Examples of the polymerized dye-forming couplers are disclosed in U.S. Pat. Nos. 3,451,820 and 4,080,211. Examples of polymerized magenta couplers are disclosed in British Pat. No. 2,102,173 and U.S. Pat. No. 4,367,282.

In order to satisfy the characteristics desired for the photographic materials, various couplers used in the present invention can be employed as a combination of two or more couplers in a light-sensitive layer, or the same compound can be employed in two or more layers.

The couplers of the present invention can be incorporated to photographic materials by the oil-in-water dispersing process. According to the oil-in-water dispersing process, dispersants are first dissolved in a single or mixed solvent of a high-boiling (having a boiling point of 175° C. or higher) organic solvent, or a low-boiling (auxiliary) organic solvent, and then dispersed as fine particles in an aqueous medium, e.g., water or an aqueous gelatine solution in the presence of surface active agents. Examples of the high-boiling organic solvents are described in U.S. Pat. No. 2,322,027. For dispersing, phase reversal of emulsion can be utilized. If necessary, prior to coating, the auxiliary solvent may be removed or reduced by distillation, "noodle" washing, or ultrafiltration.

Examples of the high-boiling organic solvents include phthalic esters (dibutyl phthalate, dicyclohexyl phthalate, di-2-ethylhexyl phthalate, and decyl phthalate, etc.), phosphoric or phosphonic esters (triphenyl phosphate, tricresyl phosphate, 2-ethylhexyldiphenyl phosphate, tricyclohexyl phosphate, tri-2-ethylhexyl phosphate, tridecyl phosphate, tributoxyethyl phosphate, trichloropropylphosphate, di-2-ethylhexylphenyl phosphonate, etc.), benzoic esters (2-ethylhexyl benzoate, dodecylbenzoate, 2-ethylhexyl-p-hydroxy benzoate, etc.), amides (diethyldodecanamide, N-tetradecylpyrrolidone, etc.), alcohols or phenols (isostearyl alcohol, 2,4-di-tert-amylphenol, etc.), aliphatic carboxylic esters (dioctylazelate, glycerol tributyrate, isostearyl lactate, trioctyl citrate, etc.), aniline derivatives (N,N-dibutyl-2-butoxy-5-tert-octylaniline, etc.), and hydrocarbons (paraffin, dodecylbenzene, diisopropylnaphthalene, etc.). The auxiliary solvents are organic solvents having a boiling point higher than about 30° C., preferably from about 50° C. to about 160° C. Examples of these solvents include ethyl acetate, butyl acetate, ethyl propionate, methyl ethyl ketone, cyclohexanone, 2-ethoxyethyl acetate, dimethylformamide, etc.

The steps and effect of the latex dispersion method and the examples of latex for impregnation are described in U.S. Pat. No. 4,199,363, and West German Application (OLS) Nos. 2,541,274 and 2,541,230.

Usually the color couplers are used in an amount of 0.001 to 1 mol per mol of photosensitive silver halides. The preferred amounts of coupler are 0.01 to 0.5 mol for yellow coupler, 0.003 to 0.3 mol for magenta coupler, and 0.002 to 0.3 mol for cyan coupler.

The photographic material which is prepared in accordance with this invention may contain, as a color antifoggant or discoloration inhibitor, a hydroquinone derivative, aminophenol derivative, amine, gallic acid derivative, catechol derivative, ascorbic acid derivative, colorless coupler, or sulfoneamidephenol derivative.

The photographic material of this invention may include compounds known as discoloration inhibitors. Typical examples of organic discoloration inhibitors are hydroquinones, 6-hydroxychroman, 5-hydroxycoumarans, spirochromans, p-alkoxyphenols, hindered phenols with bisphenols predominating, gallic acid derivatives, methylenedioxybenzenes, aminophenols, hindered amines and ether or ester derivatives obtained by silylating or alkylating the phenolic hydroxyl group of each compound above mentioned. Metal complexes represented by (bissalicylaldoximato) nickel complex and (bis-N,N-dialkyldithiocarbamato) nickel complex can also be used.

Compounds having hindered amine and hindered phenol moieties within the same molecule, described in U.S. Pat. No. 4,268,593, are useful for antifading of the yellow-dye images on exposure to heat, humidity and light. In order to prevent fading of magenta dye images, particularly on exposure to light, spiroindanes, described in Japanese Patent Application (OPI) No. 159644/1981, and chromans substituted by hydroquinone di- or mono-ethers, described in Japanese Patent Application (OPI) No. 89835/1980, provide excellent results.

In order to improve preservability, particularly fastness to light of cyan-dye images, it is useful to incorporate benzotriazole ultraviolet absorbents. Ultraviolet absorbents may be coemulsified with a cyan coupler.

The ultraviolet absorbent may be coated in an amount enough to give light stability to cyan dye images, but it is generally preferably in the range of $1\times10^{-4}\sim2\times10^{-3}$ mol/m$^2$, with a particularly preferable range of $5\times10^{-4}\sim1.5\times10^{-3}$ mol/m$^2$. Yellowing of the unexposed portion (white background) may occur if an ultraviolet absorbent is used in excess.

In the usual structure of color paper, an ultraviolet absorbent is incorporated in one layer, or preferably in both layers adjacent to the red-sensitive layer containing cyan coupler. When the ultraviolet absorbent is added in the intermediate layer between a green-sensitive layer and a red-sensitive layer, it may be coemulsified with a color-mixing preventive agent. When an ultraviolet absorbent is added to the protective layer, another additional protective layer may be coated as the outermost layer. In this protective layer, a matt agent having an arbitrary particle size may be contained.

The photographic material of the present invention may contain in its hydrophilic colloidal layer an ultraviolet absorbent.

The photographic material of this invention may contain a water-soluble dye in the hydrophilic colloid layers as a filter dye, for the prevention of irradiation and halation, or for other purposes.

The photographic material of this invention may have in the photographic emulsion layers and other hydrophilic colloid layers a brightening agent derived from stilbene, triazine, oxazole, or coumarin. It may be water-soluble in the form of dispersion when water-insoluble.

The present invention, as described above, may be applied to a multilayered, multicolor photographic material comprising a base having thereon at least two layers with different spectral sensitivities. Multilayered natural color photographic materials usually comprise a base having thereon at least one red-sensitive emulsion layer, at least one green-sensitive emulsion layer, and at least one blue-sensitive emulsion layer. The order of these layers may be optionally selected as the case demands. Each emulsion layer in these arrangements may be composed of two or more sublayers of different sensitivities, and a non-sensitive layer may be present between two or more layers of the same spectral sensitivity.

The photographic material according to the present invention may have auxiliary layers such as protective layers, intermediate layers, filter layers, antihalation layers, backing layers, etc., if necessary in addition to the silver halide emulsion layers.

Although gelatine is advantageously used as the binder or protective colloid for the photographic emulsions used in this invention, other hydrophilic colloids may also be used in this invention. For example, proteins such as gelatine derivatives, graft polymers or gelatine with other high polymers, albumin or casein, cellulose derivatives such as hydroxyethyl cellulose, carboxymethyl cellulose or cellulose sulfate, saccharide derivatives such as sodium alginate or starch derivatives, and synthetic hydrophilic high molecular weight materials such as homo- or copolymers, for example, polyvinyl alcohol, polyvinyl alcohol partial acetal, poly-N-vinylpyrrolidone, polyacrylic acid, polymethacrylic acid, polyacrylamide, polyvinylimidazole or polyvinylpyrazole can be used.

As gelatine, acid-processed gelatine or enzyme-processed gelatine as described in *Bul. Soc. Sci. Photogr. Japan,* No. 16, p. 30 (1966) may be used as well as lime-processed gelatine, and a gelatine hydrolyzate or an enzyme-decomposed product can be used.

To the photographic material of the present invention, in addition to the above described additives, may be added various photographic additives such as stabilizers, stain preventing agents, developers or precursors thereof, lubricating agents, mordants, antistatic agents, and plasticizers, examples of which are described in *Research Disclosure,* Nos. 17643 (December, 1978) and 18716 (November, 1979).

The "reflective bases" useful in this invention are those with increased light reflectivity so as to enhance the dye images formed in silver halide emulsion layers. These reflective bases include one with a surface coated with hydrophobic resin containing such light reflective material as titanium oxide, calcium carbonate, calcium sulfate, and one made by hydrophobic resin film in which reflective materials are dispersed. Specific examples of these include baryla paper, polyethylene coated paper, synthetic paper made of polypropylene, transparency bases containing reflective layers or reflective materials (e.g., glass plate, polyethyleneterephthalate), polyester film such as cellulose triacetate or cellulose nitrate, polyamide film, polycarbonate film, and polystyrene film. These bases may be selected suitably in accordance with the purpose for usage.

According to this invention, the stability of the color developer can be improved and the fogging of photographic images which appears in the continuous processing can be inhibited remarkably. Also, this invention permits a shortening of development time, as well as preventing color density from decreasing. Furthermore, by the method of this invention color photographic images excellent in color-forming property can be formed without using any benzyl alcohol.

Now, the present invention will be described in detail in accordance with examples, but the latter do not intend to limit the scope of the present invention.

EXAMPLE 1

Multi-layer color photographic papers were prepared by coating paper bases polyethylene laminated on both sides with layers shown in Table A. Coating solutions were prepared as follows:

Preparation of coating solution for the first layer

To 19.1 g of yellow coupler (a) and 4.4 g of dye image stabilizer (b), 27.2 ml of ethyl acetate and 7.9 ml of solvent (c) were added and dissolved, and the resulting solution was emulsified and dispersed in 185 ml of 10% aqueous gelatin solution containing 8 ml of 10% sodium dodecylbenzenesulfonate. On the other hand, a blue-sensitive sensitizing dye described below was added to a silver chlorobromide emulsion (containing 1 mol% of silver bromide and 70 g/kg of Ag), such that the amount of the sensitizing dye might be $5.0\times10^{-4}$ mol per mol of silver chlorobromide in order to yield 90 g of a blue-sensitive emulsion. The above emulsified dispersion was mixed with and dissolved in the thus prepared blue-sensitive emulsion. In this case, a gelatin concentration was adjusted to obtain the composition shown in Table 1. Thus the coating solution for the first layer was prepared. Coating solutions for the second to the seventh layers were prepared in the same manner as in the first layer coating solution. As a gelatin hardener for the respective layers, 1-oxy-3,5-dichloro-s-triazine sodium salt was used.

As spectral sensitizers for the respective emulsions, the following compounds were used:

Blue-sensitive emulsion layer

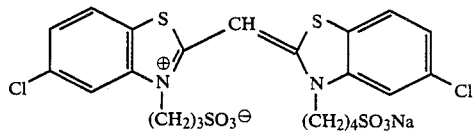

($5.0\times10^{-4}$ mol per mol of silver halide)

Green-sensitive emulsion layer

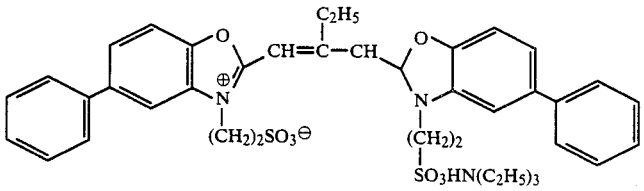

($4.0\times10^{-4}$ mol per mol of silver halide)

-continued

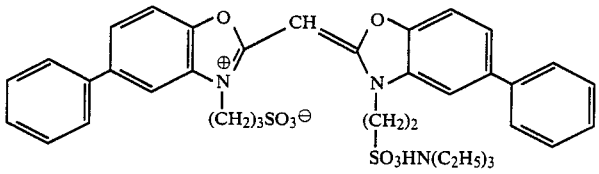

(7.0 × $10^{-4}$ mol per mol of silver halide)

Red-sensitive emulsion layer

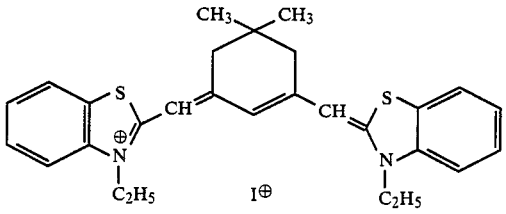

(1.0 × $10^{-4}$ mol per mol of silver halide)

The following dyes were used to protect the respective emulsion layers from irradiation.

Green-sensitive emulsion layer

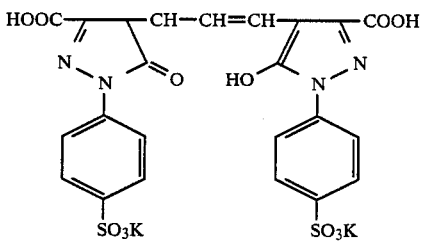

Red-sensitive emulsion layer

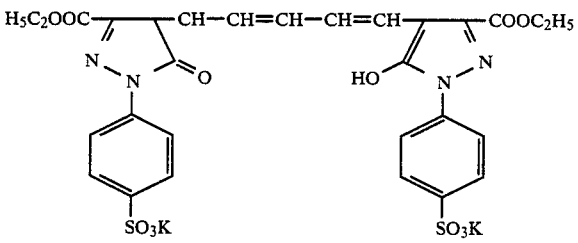

The following compounds (e.g., a coupler) were used in this Example.

(a) Yellow coupler

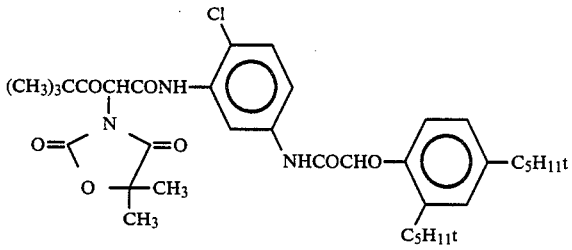

(b) Image dye stabilizer

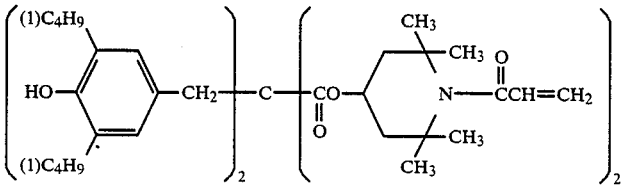

-continued
(c) Solvent
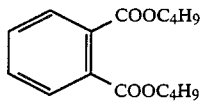
(d)
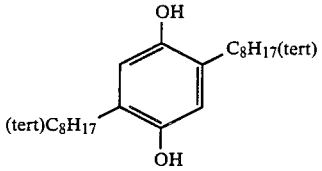
(e) Magenta coupler
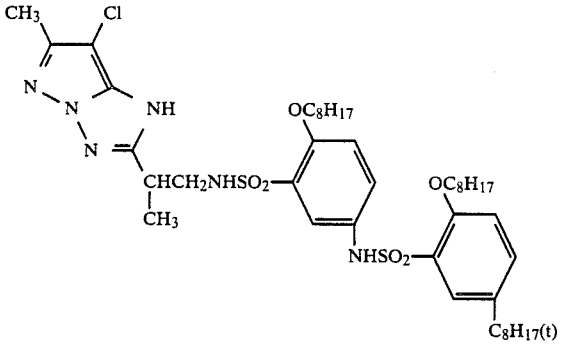
(f) Image dye stabilizer
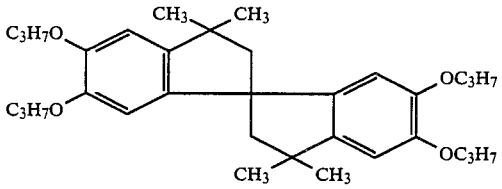
(g) Solvent
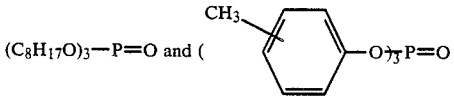
(mixture in weight ratio of 2:1)
(h) UV Absorbent
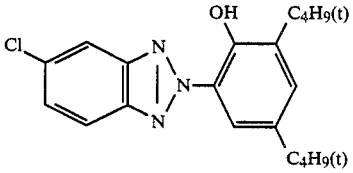
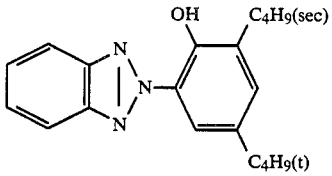
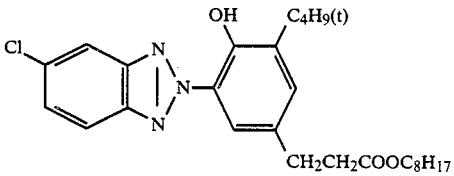
(mixture in mole ratio of 1:5:3)

-continued (i) Color mix inhibitor

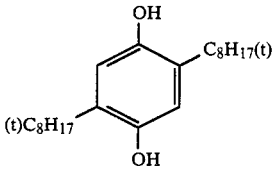

(j) Solvent (iso $C_9H_{18}O)_3P{=}O$ (k) Cyan coupler

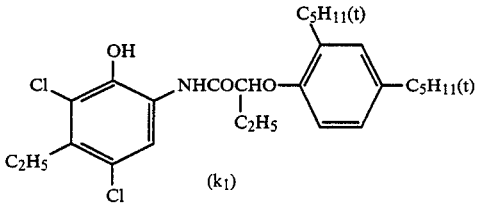

($k_1$)

and

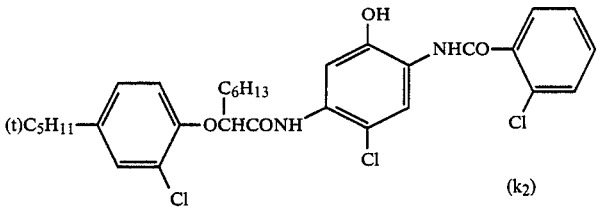

($k_2$)

(mixture in mole ratio of 1:1)

(l) Image dye stabilizer

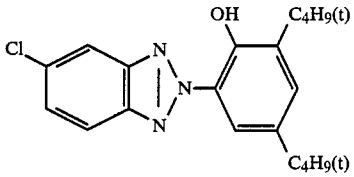

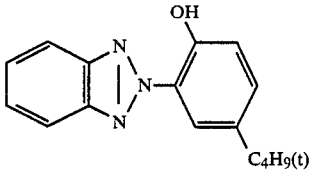

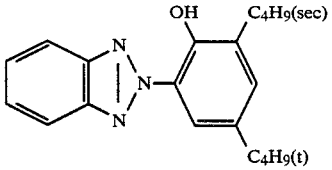

(mixture in mole ratio of 1:3:3)

(m) Solvent

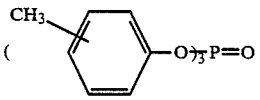

TABLE A

| Layer | Main component | | |
|---|---|---|---|
| Seventh Layer | Gelatin | 1.33 | $g/m^2$ |
| (protective layer) | Acryl-Modified Copolymer of Polyvinyl alcohol (modification degree 17%) | 0.17 | " |
| Sixth Layer | Gelatin | 0.54 | $g/m^2$ |
| (UV ray absorbing | UV Absorbent (h) | 0.21 | " |
| layer) | Solvent (i) | 0.09 | $cc/m^2$ |
| Fifth Layer | Silver Chlorobromide Emulsion (silver bromide 1 mol %) Silver: | 0.26 | $g/m^2$ |
| (red-sensitive | Gelatin | 0.98 | " |
| emulsion layer) | Cyan Coupler (k) | 0.38 | " |

TABLE A-continued

| Layer | Main component | | |
|---|---|---|---|
| | Image Dye Stabilizer (l) | 0.17 | " |
| | Solvent (m) | 0.23 | cc/m$^2$ |
| Fourth Layer (UV absorbing layer) | Gelatin | 1.60 | g/m$^2$ |
| | UV Absorbent (h) | 0.62 | " |
| | Color Mix Inhibitor (i) | 0.05 | " |
| | Solvent (j) | 0.26 | cc/m$^2$ |
| Third Layer (green-sensitive emulsion layer) | Silver Chlorobromido (refer to Table 1) Silver: | 0.16 | g/m$^2$ |
| | Gelatin | 1.80 | " |
| | Magenta Coupler (e) | 0.34 | " |
| | Image Dye Stabilizer (f) | 0.20 | " |
| | Solvent (g) | 0.68 | cc/m$^2$ |
| Second Layer (color mix preventing layer) | Gelatin | 0.99 | g/m$^2$ |
| | Color Mix Inhibitor (d) | 0.08 | " |
| First Layer (blue-sensitive emulsion layer) | Silver Chlorobromide Emulsion (silver bromide 1 mol %) Silver: | 0.30 | g/m$^2$ |
| | Gelatin | 1.86 | " |
| | Yellow Coupler (a) | 0.82 | " |
| | Image Dye Stabilizer (b) | 0.19 | " |
| | Solvent (c) | 0.34 | cc/m$^2$ |
| Base | Polyethylene Laminate Paper [a white pigment ($TiO_2$) and a bluish dye (ultramarine) were included in the first layer side] | | |

The respective multi-layer color photographic papers were prepared by altering the emulsion composition of the green-sensitive layer, as shown in Table 1. The prepared color photographic papers were then processed in the following steps:

| Processing Steps | Temp. | Time |
|---|---|---|
| Color Development | 35° C. | 45 sec |
| Bleach-Fixing | 35° C. | 45 sec |
| Rinsing 1 | 35° C. | 20 sec |
| Rinsing 2 | 35° C. | 20 sec |
| Rinsing 3 | 35° C. | 20 sec |
| Drying | 80° C. | 60 sec |

The rinsing operation was carried out by a three-tank counter flow water washing system, feeding water from the tank of the third rinsing to the tank of the first rinsing. The composition of the respective processing solutions were as follows:

| Color Developer | |
|---|---|
| Hydroxylamine | See Table 1 |
| Benzyl alcohol | See Table 1 |
| Diethylene Glycol | See Table 1 |
| Sodium Sulfite | 0.2 g |
| Potassium Carbonate | 30 g |
| EDTA.2Na | 1 g |
| Sodium Chloride | 1.5 g |
| 4-Amino-3-methyl-N—ethyl-N—[β-(methane sulfonamido)-ethyl]-p-phenylenediamine Sulfate | 5.0 g |
| Brightening Agent (4,4'-diaminostilbene series) | 3.0 g |
| Potassium Bromide | 0.01 g |
| Water | q.s. to 1,000 ml |
| pH | 10.05 |

-continued

| Bleach-Fix Solution | |
|---|---|
| EDTAFe(III) $NH_4.2H_2O$ | 60 g |
| EDTA.2Na.$2H_2O$ | 4 g |
| Ammonium Thiosulfate (70%) | 120 ml |
| Sodium Sulfite | 16 g |
| Glacial Acetic Acid | 7 g |
| Water | q.s. to 1,000 ml |
| pH | 5.5 |
| **Rinsing Solution** | |
| Formalin (37%) | 0.1 ml |
| 1-Hyroxyethylidene-1,1-diphosphonic Acid (60%) | 1.6 ml |
| Bismuth Chloride | 0.35 g |
| Aqueous Ammonia (26%) | 2.5 ml |
| Nitrilotriacetic Acid.3Na | 1.0 g |
| EDTA.4H | 0.5 g |
| Sodium Sulfite | 1.0 g |
| 5-Chloro-2-methyl-4-isothiazoline-3-one | 50 mg |
| Water | q.s. to 1,000 ml |

A part of the thus obtained color developer was allowed to stand at 40° C. for 14 days, and afterward the above-mentioned processing steps were carried out again using the developer which had been left standing.

The processing using the color developer which had been allowed to stand for the 14 days was called a stood solution test, and the processing using the color developer prior to standing was called a fresh solution test.

Photographic properties in the stood solution test and the fresh solution test are set forth in Table 1.

The photographic properties are represented by Dmin for the magenta density and gradation.

The Dmin represents a minimum density, and the gradation represents a density variation of from a density point of 0.5 to a density point on an exposure side which is 0.3 higher in log E.

TABLE 1

| No. | Composition of Emulsion (silver chloride mol %) | Benzyl Alcohol/ Diethylene Glycol (ml) (ml) | Hydroxylamine Compound (0.04 mol/l) | | Fresh Solution D min | Fresh Solution Gradation | Stood Solution D min | Stood Solution Gradation |
|---|---|---|---|---|---|---|---|---|
| 1 | 99 | — | Hydroxylamine | Comparative Example | 0.12 | 0.54 | 0.16 | 0.65 |
| 2 | 99 | 15/10 | Hydroxylamine | Comparative Example | 0.13 | 0.73 | 0.20 | 0.88 |
| 3 | 99 | — | I - 1 | This Invention | 0.12 | 0.70 | 0.12 | 0.70 |
| 4 | 99 | — | I - 5 | This Invention | 0.12 | 0.70 | 0.12 | 0.70 |

TABLE 1-continued

| No. | Composition of Emulsion (silver chloride mol %) | Benzyl Alcohol/ Diethylene Glycol (ml) (ml) | Hydroxylamine Compound (0.04 mol/l) | | Fresh Solution D min | Fresh Solution Gradation | Stood Solution D min | Stood Solution Gradation |
|---|---|---|---|---|---|---|---|---|
| 5 | 99 | — | I - 6 | This Invention | 0.12 | 0.70 | 0.12 | 0.71 |
| 6 | 99 | 15/10 | I - 5 | This Invention | 0.12 | 0.71 | 0.13 | 0.73 |
| 7 | 90 | — | I - 5 | This Invention | 0.12 | 0.69 | 0.12 | 0.70 |
| 8 | 50 | — | I - 5 | This Invention | 0.12 | 0.67 | 0.12 | 0.70 |
| 9 | 99 | — | I - 3 | This Invention | 0.12 | 0.69 | 0.12 | 0.70 |
| 10 | 99 | — | I - 8 | This Invention | 0.12 | 0.70 | 0.12 | 0.70 |
| 11 | 99 | — | I - 12 | This Invention | 0.12 | 0.68 | 0.14 | 0.70 |
| 12 | 99 | — | I - 16 | This Invention | 0.12 | 0.70 | 0.13 | 0.71 |
| 13 | 99 | — | I - 22 | This Invention | 0.12 | 0.71 | 0.14 | 0.71 |
| 14 | 99 | — | I - 26 | This Invention | 0.12 | 0.70 | 0.12 | 0.71 |

When hydroxylamine was used as a preservative, the color density decreased and the fogging by the stood solution increased (No. 1); when hydroxylamine was used in the presence of benzyl alcohol, the fogging by the stood solution increased remarkbly (No. 2).

According to the invention, the increase in the fogging by the stood solution was slight, and in particular, when benzyl alcohol was not present, the fogging improved remarkably.

EXAMPLE 2

Each paper was laminated on both surfaces with a polyethylene by a corona discharge technique, and the thus laminated paper was coated with a first layer (lower-most layer) to a seventh layer(uppermost layer), as shown in Table B, to produce specimens.

A coating solution of the first layer was prepared as follows: To a mixture of 200 g of a yellow coupler were added 93.3 g of a discoloration inhibitor, 10 g of a high-boiling solvent (p), 5 g of another high-boiling solvent (q), and 600 ml of ethyl acetate as an auxiliary solvent. The mixture was then heated to 60° C. to dissolve the respective components, and it was further mixed with 3,300 ml of a 5% aqueous gelatin solution containing 330 ml of a 5% aqueous solution of Alkanol B (Tradename, alkylnaphthalene sulfonate; Du Point). Emulsification was then carried out using a colloid mill to prepare a coupler dispersion. Next, ethyl acetate was distilled out from this dispersion under reduced pressure, and the dispersion was then added to 1,400 g of an emulsion (containing 96.7 g of Ag and 170 g of gelatin) composed of a sensitizing dye for a blue-sensitive emulsion layer and 1-methyl-2-mercapto-5-acetylamino-1,3,4-triazole. Then, 2,600 g of a 10% aqueous gelatin solution was added to prepare the desired coating solution. The second to seventh layers were prepared in the same manner as the first layer.

TABLE B

| Layer | Main Component | |
|---|---|---|
| Seventh Layer (protective layer) | Gelatain | 600 mg/m$^2$ |
| Sixth Layer (UV absorbing layer) | UV Absorbent (n) | 260 mg/m$^2$ |
| | UV Absorbent (o) | 70 mg/m$^2$ |
| | Solvent (p) | 300 mg/m$^2$ |
| | Solvent (q) | 100 mg/m$^2$ |

TABLE B-continued

| Layer | Main Component | |
|---|---|---|
| | Gelatin | 700 mg/m$^2$ |
| Fifth Layer (red-sensitive layer) | Silver Chlorobromide Emulsion (silver bromide 1 mol %) | 210 mg/m$^2$ |
| | Cyan Coupler (C-2) | 260 mg/m$^2$ |
| | Cyan Coupler (C-1) | 120 mg/m$^2$ |
| | Discoloration Inhibitor (r) | 250 mg/m$^2$ |
| | Solvent (p) | 160 mg/m$^2$ |
| | Solvent (q) | 100 mg/m$^2$ |
| | Gelatin | 1800 mg/m$^2$ |
| Fourth Layer (color mix inhibiting layer) | Color Mix Inhibitor (s) | 65 mg/m$^2$ |
| | UV Absorbent (n) | 450 mg/m$^2$ |
| | UV Absorbent (o) | 250 mg/m$^2$ |
| | Solvent (p) | 50 mg/m$^2$ |
| | Solvent (q) | 50 mg/m$^2$ |
| | Gelatin | 1700 mg/m$^2$ |
| Third Layer (green-sensitive layer) | Silver Chlorobromide Emulsion (silver bromide 0.5 mol %) | 305 mg/m$^2$ |
| | Magenta Coupler | 670 mg/m$^2$ |
| | Discoloration Inhibitor (t) | 150 mg/m$^2$ |
| | Discoloration Inhibitor (u) | 10 mg/m$^2$ |
| | Solvent (p) | 200 mg/m$^2$ |
| | Solvent (q) | 10 mg/m$^2$ |
| | Gelatin | 1400 mg/m$^2$ |
| Second Layer (discoloration inhibiting layer) | Silver Bromide Emulsion (no after-ripening, grain diameter 0.05 microns) Silver | 10 mg/m$^2$ |
| | Discoloration inhibitor (s) | 55 mg/m$^2$ |
| | Solvent (p) | 30 mg/m$^2$ |
| | Solvent (q) | 15 mg/m$^2$ |
| | Gelatin | 800 mg/m$^2$ |
| First Layer (blue-sensitive layer) | Silver chlorobromide Emulsion (silver bromide 1 mol %) | 290 mg/m$^2$ |
| | Yellow Coupler | 600 mg/m$^2$ |
| | Discoloration Inhibitor (r) | 280 mg/m$^2$ |
| | Solvent (p) | 30 mg/m$^2$ |
| | Solvent (q) | 15 mg/m$^2$ |
| | Gelatin | 1800 mg/m$^2$ |
| Base | Paper, both surfaces of which were laminated with polyethylene | |

Green-Sensitive Emulsion Layer:

Anhydro-9-ethyl-5,5'-diphenyl-3,3'-disulfoethyloxacarbocyanine Hydroxide

Red-Sensitive Emulsion Layer:

3,3'-Diethyl-5-methoxy-9,9'-(2,2-dimethyl-1,3-propano)-thiadicarbocyanine Iodide As a stabilizer for the respective emulsions, 1-methyl-2-mercapto-5-acetylamino-1,3,4-triazole was used.

Further, as irradiation inhibiting dyes, the following compounds were used:

4-(3-Carboxy-5-hydroxy-4-(3-(3-carboxy-5-oxo-1-(4-sulfonatophenyl)-2-pyrazoline-4-iridene)-1-propenyl)-1-pyrazolyl)benzene sulfonate dipotassium salt and N,N'-(4,8-dihydroxy-9,10-dioxo-3,7-disulfonatoanthracene-1,5-diyl)bis(aminomethane sulfonate) tetrasodium salt.

Additionally, as a hardening agent, 1,2-bis(vinylsulfonyl)ethane was used.

The following coupler was used.

-continued

| | |
|---|---|
| Compound of this invention (General Formula II-a. II-b or II-c) | See Table 2 |
| Hydroxylamine | See Table 2 |
| Potassium Carbonate | 30 g |
| N—Ethyl-N—(β-methanesulfonamidoethyl)-3-methyl-4-aminoaniline Sulfate | 5.5 g |
| Brightening Agent (4,4'-diaminostilbene series) | 1.0 g |
| Water | q.s. to 1,000 ml |
| [pH was adjusted to 10.10 with KOH] | |
| Bleach-Fix Solution | |
| Ammonium Thiosulfate (70%) | 150 ml |
| Sodium Sulfite | 15 g |

Yellow coupler

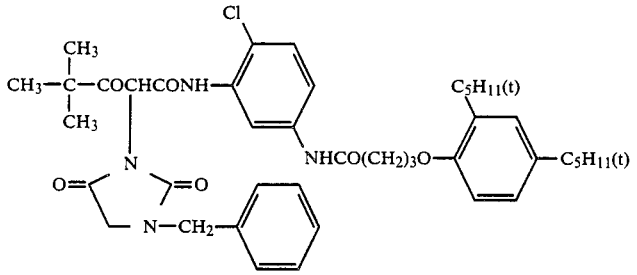

Magenta coupler

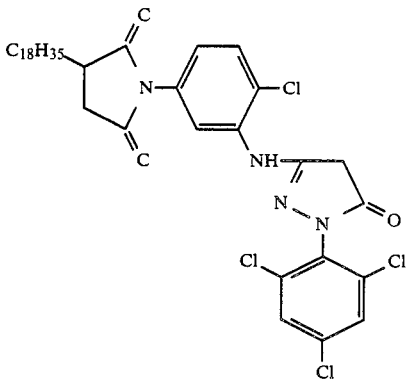

Cyan coupler (mixture of C-1 and C-2 in a molar ratio of 50:50)

C-1

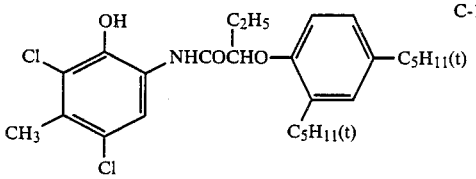

C-2

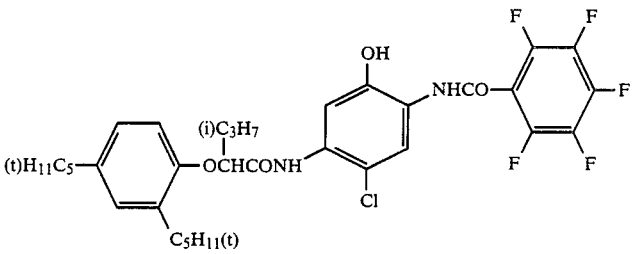

The thus prepared multi-layer color photographic papers were subjected to a exposure through a wedge and then processed according to the following processing steps:

| Processing Steps | Time | Temp. |
|---|---|---|
| Color Development | 3 min 30 sec | 33° C. |
| Bleach-Fix | 1 min 30 sec | 33° C. |
| Rinsing (3-tank cascade) | 2 min | 30° C. |
| Drying | 1 min | 80° C. |

The processing solutions used were as follows:

| | |
|---|---|
| Color Developer | |
| Water | 800 ml |
| Benzyl Alcohol | See Table 2 |
| Triethanolamine | See Table 2 |
| N,N'—Bis(2-hydroxybenzyl)-ethylenediamine-N,N'—diacetic Acid | 0.1 g |
| Nitrilo-N,N,N—trimethylenephosphonic Acid (40%) | 1.0 g |
| Potassium Bromide | 0.6 g |
| Ethylenediamine Iron (III) Ammonium | 60 g |
| Ethylenediaminetetraacetic Acid | 10 g |
| Brightening Agent (4,4'-diaminostilbene series) | 1.0 g |
| 2-Mercapto-5-amino-3,4-thiadiazole | 1.0 g |
| Water | q.s. to 1,000 ml |
| [pH was adjusted to 7.0 with aqueous ammonia] | |
| Rinsing Solution | |
| 5-Chloro-2-methyl-4-isothiazoline-3-one | 40 mg |
| 2-Methyl-4-isothiazoline-3-one | 10 mg |
| 2-Octyl-4-isothiazoline-3-one | 10 mg |
| Bismuth Chloride (40%) | 0.5 g |
| Nitrilo-N,N,N—trimethylenephosphonic Acid (40%) | 1.0 g |
| 1-Hyroxyethylidene-1,1-diphosphonic Acid (40%) | 2.5 g |
| Brightening Agent (4,4'-diaminostilbene series) | 1.0 g |
| Aqueous Ammonia (26%) | 2.0 ml |
| Water | q.s. to 1,000 ml |
| [pH was adjusted to 7.5 with KOH] | |

In the same manner as in Example 1, Dmin of the magenta and gradations in fresh and stood states were sought, and the results are set forth in Table 2.

TABLE 2

| No. | Benzyl Alcohol/ Triethanolamine (ml) (ml) | Hydroxylamine Compound (0.04 mol/l) | Compound of General Formula II-a, II-b or II-c ($5 \times 10^{-4}$ mol/l) | | Fresh Solution D min | Fresh Solution Gradation | Stood Solution D min | Stood Solution Gradation |
|---|---|---|---|---|---|---|---|---|
| 9 | — | Hydroxylamine | IIc - 28 | Comparative Example | 0.11 | 0.56 | 0.15 | 0.67 |
| 10 | 15/10 | Hydroxylamine | — | Comparative Example | 0.15 | 0.60 | 0.23 | 0.72 |
| 11 | 15/10 | — | IIc - 28 | Comparative Example | 0.13 | 0.73 | 0.17 | 0.74 |
| 12 | — | I - 5 | — | This Invention | 0.11 | 0.72 | 0.13 | 0.73 |
| 13 | — | I - 5 | IIa - 1 | This Invention | 0.11 | 0.73 | 0.11 | 0.73 |
| 14 | — | I - 5 | IIa - 3 | This Invention | 0.11 | 0.72 | 0.12 | 0.73 |
| 15 | — | I - 5 | IIa - 9 | This Invention | 0.11 | 0.71 | 0.12 | 0.72 |
| 16 | — | I - 5 | IIa - 10 | This Invention | 0.11 | 0.72 | 0.12 | 0.73 |
| 17 | — | I - 5 | IIb - 2 | This Invention | 0.11 | 0.73 | 0.11 | 0.73 |
| 18 | — | I - 5 | IIc - 16 | This Invention | 0.11 | 0.72 | 0.11 | 0.72 |
| 19 | — | I - 5 | IIc - 27 | This Invention | 0.11 | 0.72 | 0.11 | 0.72 |
| 20 | — | I - 5 | IIc - 28 | This Invention | 0.11 | 0.72 | 0.11 | 0.73 |
| 21 | 15/10 | I - 5 | IIc - 28 | This Invention | 0.11 | 0.73 | 0.13 | 0.74 |
| 22 | 0/10 | I - 5 | IIa - 1 | This Invention | 0.11 | 0.73 | 0.11 | 0.73 |
| 23 | 0/10 | I - 5 | IIc - 28 | This Invention | 0.11 | 0.72 | 0.11 | 0.73 |
| 24 | — | I - 5 | IIb - 5 | This Invention | 0.11 | 0.72 | 0.12 | 0.73 |
| 25 | — | I - 5 | IIb - 7 | This Invention | 0.11 | 0.73 | 0.12 | 0.74 |

Even when the antifoggant of this invention was used in the presence of benzyl alcohol, the fogging by the stood solution could not be prevented sufficiently (No. 11), and the simultaneous employment of hydroxylamine and the antifoggant led to the deterioration in color-forming properties and could not satisfactorily prevent the fogging of the stood solution (No. 9). When the hydroxylamine according to this invention was used, excellent color-forming properties could be obtained and the fogging of the stood solution decreased (No. 12). When the antifoggant was simultaneously used therewith in this invention, the prevention of fogging was excellent (Nos. 13, 14, 15, 16, 17, 18, 19, 20, 24 and 25). When benzyl alcohol was present, the prevention of fogging slightly declined (No. 21).

EXAMPLE 3

The same procedure as in Example 2 was repeated except that no potassium bromide was used in the color developer and the color developing time was 1 minute. When the hydroxylamine of this invention was used, less fogging appeared and the color-forming properties were good. When the antifoggant according to this invention was simultaneously employed therewith, these effects were more remarkable.

EXAMPLE 4

The same procedure as in Experiment No. 13 in Example 2 was repeated except that the IIa-1 compound was replaced with the following antifoggants, in order to test photographic properties. As a result, the forming properties markedly deteriorated, such that preferable results could not be obtained.

Comparative antifoggant 1

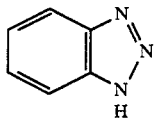

Comparative anitfoggant 2

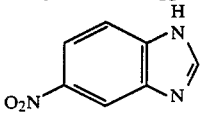

Comparative antifoggant 3

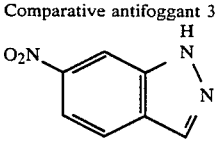

Comparative antifoggant 4

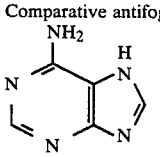

Having described our invention as related to the embodiment, it is our intention that the invention not be limited by any of the details of the description, unless otherwise specified, but rather be construed broadly within the spirit and scope set out in the accompanying claims.

What we claim is:

1. A method of processing a silver halide color photographic material, which comprises imagewise exposing a silver halide color photographic material to light and then processing the silver halide color photographic material with a color developing containing (i) an aromatic primary amine color developing agent, (ii) a hydroxylamine compound represented by formula (I):

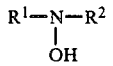

formula (I)

wherein $R^1$ and $R^2$ each represent an unsubstituted or substituted alkyl, alkenyl or aryl group and may optionally be joined together to form a nitrogen-containing heterocyclic ring together with the associated nitrogen atom, and (iii) at least one compound selected from the group consisting of formulae (II-a), (II-b) and (II-c):

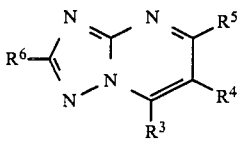

formula (II-a)

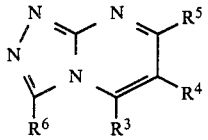

formula (II-b)

wherein $R^3$, $R^4$, $R^5$ and $R^6$, which may be the same or different, each represent a hydrogen atom; an unsubstituted or substituted alkyl, aryl or amino group; a hydroxyl group; an alkoxy group; an alkylthio group; a carbamoyl group which may optionally be substituted; a halogen atom; a cyano group; a carboxyl group; an alkoxycarbonyl group, or a heterocyclic group; and $R^3$ and $R^4$ and $R^5$ may optionally form a 5 or 6-membered ring in combination, with the proviso that at least one of $R^3$ and $R^5$ represents a hydroxyl group, Z—S—M formula (II-c)

wherein M represents a hydrogen atom, cation or —S—Z, and Z represents a heterocyclic group containing at least one nitrogen atom.

2. The method as claimed in claim 1, wherein the color developer is substantially free of benzyl alcohol.

3. The method as claimed in claim 1, wherein the silver halide color photographic material has at least one layer of a silver halide emulsion containing silver halide grains which contain at least 60 mole % of silver chloride.

4. The method as claimed in claim 1, wherein at least one of $R^1$ and $R^2$ is a group having one or more further substitutents.

5. The method as claimed in claim 4, wherein the substituent or the groups represented by each of $R^1$ and $R^2$ is a halogen atom, aryl group, alkoxy group, aryloxy group, sulfonyl group, sulfonamido group, sulfamoyl group, carbamoyl group, amido group, ureido group, alkoxycarbonylamino group, aryloxycarbonylamino group, alkoxycarbonyl group, aryloxycarbonyl group, cyano group, hydroxyl group, carboxyl group, sulfo group, nitro group, amino group, alkylthio group, arylthio group, or heterocyclic group.

6. The method as claimed in claim 4, wherein the substituent or $R^1$ and $R^2$ is a hydroxyl group, alkoxy group, sulfonyl group, amido group carboxyl group, cyano group, sulfo group, nitro group, or amino group.

7. The method as claimed in claim 1, wherein $R^1$ and $R^2$ have 1–10 carbon atoms.

8. The method as claimed in claim 1, wherein the nitrogen-containing heterocyclic ring which is formed when $R^1$ and $R^2$ are joined together is a piperidiyl group, pyrrolidinyl groupl, N-alkylpiperazyl group, morpholinyl group, indolinyl group or benztriazolyl group.

9. The method as claimed in claim 1, wherein the hydroxylamine compound is included in an amount of 0.1–20 g per liter of the color developer.

10. The method as claimed in claim 1, wherein the compounds of the general formula (IIa), (IIb) and (IIc) are each included in an amount of 5 mg–3 g per liter of the color developer.

11. The method as claimed in claim 1, wherein the color developer does not contain hydroxylamine.

12. The method as claimed in claim 1, wherein the color developer has a pH in the range of 9–11.

13. The method as claimed in claim 1, wherein the color developer further comprises 0–5 g/l of sulfite as a preservative.

14. The method as claimed in claim 1, wherein the color developer is free of benzyl alcohol.

15. The method as claimed in claim 5, wherein the substituents are selected from the group consisting of fluorine, chlorine, bromine, phenyl, p-chlorophenyl, methoxy, ethoxy, methoxyethoxy, phenoxy, methanesulfonyl, p-toluenesulfonyl, methanesulfonamido, benzenesulfonamido, diethylsulfamoyl, unsubstituted sulfamoyl, unsubstituted carbamoyl, diethylcarbamoyl, acetamido, benzamido, methylureido, phenylureido, methoxycarbonylamino, phenoxycarbonylamino, methoxycarbonyl, phenoxycarbonyl, unsubstituted amino, diethylamino, methylthio, phenylthio, morpholinyl and pyridyl.

16. The method as claimed in claim 1, wherein the compound of formula (I) is a salt of an acid selected from the group consisting of hydrochloric acid, sulfuric acid, nitric acid, phosphoric acid, oxalic acid and acetic acid.

17. The method as claimed in claim 1, wherein the compound of formula (I) is present in an amount of 0.1 to 20 g per liter of the color developer.

18. The method as claimed in claim 1, wherein $R^3$, $R^4$, $R^5$ and $R^6$ may be the same or different and represent a substituted or unsubstituted alkyl group which has 1–20 carbon atoms in a cyclic or branched form, an unsubstituted or substituted monocyclic or bicyclic aryl group, an alkoxy group having 1–20 carbon atoms, an alkylthio group having 1–6 carbon atoms, a carbamoyl group which optionally has one or more aliphatic or aromatic groups as a substituent, an alkoxycarbonyl group having 2–20 carbon atoms, or a heterocyclic group containing a 5 or 6-membered ring having one or more hetero atoms selected from the group consisting of nitrogen, oxygen, sulfur atoms and combinations thereof.

19. The method as claimed in claim 1, wherein unsubstituted alkyl groups are selected from the group consisting of methyl, ethyl, n-propyl, i-propyl, n-butyl, t-butyl, hexyl, cyclohexyl, cyclopentylmethyl, octyl, dodecyl, tridecyl and heptadecyl; the substituted alkyl groups are selected from the group consisting of monocyclic and bicyclic aryl groups, heterocyclic groups, halogen atoms, carboxyl groups, alkoxycarbonyl groups having 2–6 carbon atoms, alkoxy groups having not more than 20 carbon atoms and hydroxyl groups.

20. The method as claimed in claim 1, wherein the substituted alkyl group is selected from the group consisting of benzyl, phenethyl, chloromethyl, 2-chloroethyl, trifluoromethyl, carboxymethyl, 2-carboxyethyl, 2-(methoxycarbonyl)ethyl, ethoxycarbonylmethyl, 2-methoxyethyl, hydroxymethyl and 2-hydroxyethyl; the unsubstituted aryl group is a phenyl group or a naphthyl group; the substituted aryl group contains substituents selected from the group consisting of alkyl group having 1–4 carbon atoms, halogen atoms, nitro groups, carboxyl groups, alkoxycarbonyl groups having 2–6 carbon atoms, hydroxyl groups and alkoxy groups having 1–6 carbon atoms; the amino group represented by each of $R^3$, $R^4$, $R^5$ and $R^6$ have a substituent selected from the group consisting of alkyl groups and acyl groups.

21. The method as claimed in claim 1, wherein the carbamoyl group represented by each of $R^3$, $R^4$, $R^5$ and $R^6$ contains as substituent or substituents one or more alkyl groups having 1–20 carbon atoms, monocyclic or bicyclic aryl groups; the alkoxycarbonyl group represented by each of $R^3$, $R^4$, $R^5$ and $R^6$ is a methoxycarbonyl group, ethoxycarbonyl group or a butoxycarbonyl group; the heterocyclic group represented by each of $R^3$, $R^4$, $R^5$ and $R^6$ is a monocyclic or a fused bicyclic or tricyclic ring; and a ring formed by $R^3$ and $R^4$ or by $R^4$ and $R^5$ is a cyclopentane, cyclohexane, cyclohexene, benzene, furan, pyrrolidine or a thiophene ring.

22. The method as claimed in claim 1, wherein $R^6$ is a substituted alkyl group represented by the following formula

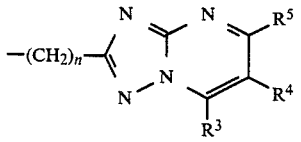

wherein $R^3$, $R^4$ and $R^5$ have the same meaning as defined above and n represents 2 or 4.

23. The method as claimed in claim 1, wherein the heterocyclic group represented by Z in formula (II-c) is a fused group selected from the group consisting of imidazole, triazole, tetrazole, thiazole, oxazole, selenazole, benzimidazole, benzoxazole, benzthiazole, thiadiazole, oxadiazole, benzselenazole, pyrazole, pyrimidine, triazine, pyridine, naphthothiazole, naphthoimidazole, naphthoxazole, azabenzimidazole, purine and azaindenes.

24. The method as claimed in claim 1, wherein the heterocyclic groups are substituted by substituents selected from the group consisting of alkyl groups, alkenyl groups, aralkyl groups, aryl groups, heterocyclic groups, halogen atoms, mercapto, cyano, carboxyl, sulfo, hydroxyl, carbamoyl, sulfamoyl, amino groups, nitro groups, alkoxy groups, aryloxy groups, acryl groups, acylamino groups, substituted amino groups, alkyl-thio groups, aryl-thio groups, alkoxycarbonyl groups and aryloxycarbonyl groups.

25. The method as claimed in claim 1, wherein the aromatic primary amine color developing agent is a p-phenylenediamine derivative.

26. The method as claimed in claim 1, wherein the aromatic primary amine color developing agent is present in an amount of about 0.1 g to about 20 g per liter of color developer.

27. The method as claimed in claim 1, wherein the compound represented by formula (I) is selected from the group consisting of

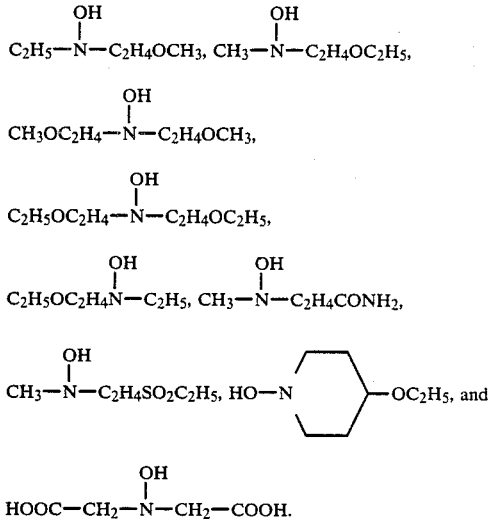

28. The method as claimed in claim 1, wherein the compound represented by formula (I) is selected from the group consisting of

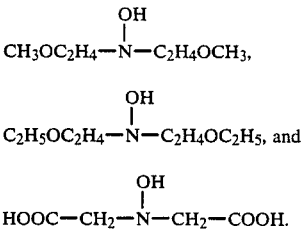

29. The method as claimed in claim 1, wherein the compound represented by formula (I) is

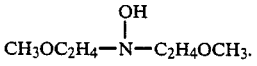

30. The method as claimed in claim 4, wherein $R^1$ and $R^2$ both have a substituent.

31. The method as claimed in claim 6, wherein the substituent or $R_1$ and $R_2$ is an alkoxy group.

* * * * *